US009673533B2

(12) United States Patent
Balma et al.

(10) Patent No.: US 9,673,533 B2
(45) Date of Patent: Jun. 6, 2017

(54) SLOTTED WAVEGUIDE ANTENNA FOR NEAR-FIELD FOCALIZATION OF ELECTROMAGNETIC RADIATION

(71) Applicant: SELEX ES S.p.A., Rome (IT)

(72) Inventors: Massimo Balma, Rome (IT); Giacomo Guarnieri, Rome (IT); Giuseppe Mauriello, Rome (IT); Erasmo Recami, Rome (IT); Michel Zamboni Rached, Rome (IT); Angelo Freni, Rome (IT); Agnese Mazzinghi, Rome (IT); Matteo Albani, Rome (IT)

(73) Assignee: SELEX ES S.p.A. (IT)

( * ) Notice: Subject to any disclaimer, the term of this patent is extended or adjusted under 35 U.S.C. 154(b) by 84 days.

(21) Appl. No.: 14/369,684

(22) PCT Filed: Dec. 28, 2012

(86) PCT No.: PCT/IB2012/057802
§ 371 (c)(1),
(2) Date: Jun. 28, 2014

(87) PCT Pub. No.: WO2013/098795
PCT Pub. Date: Jul. 4, 2013

(65) Prior Publication Data

US 2014/0354498 A1 Dec. 4, 2014

(30) Foreign Application Priority Data

Dec. 29, 2011 (IT) ..... TO2011A1232

(51) Int. Cl.
*H01Q 13/10* (2006.01)
*H01Q 13/18* (2006.01)
*H01Q 21/00* (2006.01)

(52) U.S. Cl.
CPC ..... *H01Q 13/18* (2013.01); *H01Q 21/0006* (2013.01); *H01Q 21/0012* (2013.01)

(58) Field of Classification Search
CPC ..... H01Q 21/0012; H01Q 13/18; H01Q 21/0006; H01Q 13/10; H01Q 13/085;
(Continued)

(56) References Cited

U.S. PATENT DOCUMENTS 2,908,001 A * 10/1959 Kelly ..... H01Q 21/0012 343/756
2,929,064 A * 3/1960 Kelly ..... H01Q 13/18 343/771

(Continued)

FOREIGN PATENT DOCUMENTS

DE 3338261 * 5/1985
GB 2235590 * 3/1991

OTHER PUBLICATIONS

The ARRL Antenna Book, Published by The American Radio Relay League.*

(Continued)

*Primary Examiner* — Dameon E Levi
*Assistant Examiner* — Awat Salih
(74) *Attorney, Agent, or Firm* — The Belles Group, P.C.

(57) ABSTRACT

A radial slot antenna comprising a radial waveguide, which includes an upper plate, having a centroid and an edge region and provided with a plurality of radiating apertures, formed as slots in the upper plate, which develop around the centroid. The radiating apertures are arranged to form first and second radiating regions, which are distinct and radially separated by a dwell region without radiating apertures and wherein, in the first and second radiating regions, radially adjacent radiating apertures are separated from one another by a radial distance, the dwell region having a radial width (Continued)

greater than the radial distances of the radiating apertures in the first and second radiating regions. The slot antenna further comprises a signal feeder for supplying am electromagnetic field to assume, in the first and second radiating regions, opposite phases, so that the electromagnetic field emitted by the slot antenna can be expressed via Bessel functions.

8 Claims, 18 Drawing Sheets

(58) Field of Classification Search
CPC ..... H01Q 13/106; H01Q 21/0043; H01Q 21/064; H01Q 21/20; H01Q 21/005
USPC ..... 343/770, 771, 895, 767, 768, 769
See application file for complete search history.

(56) References Cited

U.S. PATENT DOCUMENTS 2,981,949 A * 4/1961 Elliott ..... H01Q 3/14 343/754
3,022,506 A * 2/1962 Goebels, Jr. ..... H01Q 21/0012 343/766
3,063,049 A * 11/1962 Kelly ..... H01Q 13/10 343/771
3,233,242 A * 2/1966 Voronoff ..... H01Q 17/001 333/239
4,536,767 A * 8/1985 Rembold ..... H01Q 1/38 343/753
5,049,895 A * 9/1991 Ito ..... H01Q 21/0012 343/771
5,661,498 A * 8/1997 Goto ..... H01Q 21/064 343/770
6,020,858 A * 2/2000 Sagisaka ..... H01Q 21/005 343/770
6,124,833 A * 9/2000 Bialkowski ..... H01Q 13/22 343/770
6,396,440 B1 * 5/2002 Chen ..... H01Q 21/0012 343/700 MS
6,897,823 B2 * 5/2005 Iida ..... H01Q 21/0087 343/700 MS
7,233,297 B1 * 6/2007 Harvey ..... H01Q 13/10 343/768
7,243,610 B2 * 7/2007 Ishii ..... H01J 37/3244 118/723 AN
2004/0027302 A1 * 2/2004 Ishii ..... H01J 37/3222 343/770
2004/0045674 A1 * 3/2004 Ishii ..... H01J 37/3222 156/345.48
2005/0099349 A1 * 5/2005 Krig ..... G01F 23/284 343/770
2006/0001587 A1 * 1/2006 Pintos ..... H01Q 13/10 343/771
2012/0160809 A1 * 6/2012 Ishibashi ..... C23C 16/511 216/69
2012/0162039 A1 * 6/2012 Amano ..... H01Q 21/064 343/767
2015/0029055 A1 * 1/2015 Yano ..... H01Q 13/22 342/26 R

OTHER PUBLICATIONS

Corresponding International Search Report and Written Opinion PCT/IB2012/057802 dated Apr. 12, 2013.

* cited by examiner

SLOTTED WAVEGUIDE ANTENNA FOR NEAR-FIELD FOCALIZATION OF ELECTROMAGNETIC RADIATION

CROSS-REFERENCE TO RELATED PATENT APPLICATIONS

The present application is a U.S. national stage application under 35 U.S.C. §371 of PCT Application No. PCT/IB2012/057802, filed Dec. 28, 2012, which claims priority to Italian Application No. TO2011A001232, filed Dec. 29, 2011, the entireties of which are incorporated herein by reference.

TECHNICAL FIELD

The present invention relates to a slotted waveguide antenna, in particular a localized-wave (or non-diffractive) antenna.

BACKGROUND ART

As is known, diffraction and dispersion are phenomena that limit the applications of beams and pulses of electromagnetic and acoustic waves.

Diffraction is present whenever a wave is propagated in a medium, producing a continuous spatial widening. Said effect constitutes a limiting factor in remote-sensing applications and whenever it is necessary to generate a pulse that will maintain its own transverse localization, such as, for example, in free-space communications, in electromagnetic "tweezers", etc.

The dispersion acts on pulses that propagate in a material, and mainly generates a temporal widening of the pulses on account, as is known, of the different phase velocity for each spectral component of each pulse (due to the variation of the index of refraction of the medium as a function of frequency). Consequently, a pulsed signal may undergo degradation due to a temporal widening of its spectrum, which is undesirable. The dispersion is hence a further limiting factor when there is the need for a pulse to maintain its own spectral characteristics, in particular its width over time, such as, for example, in communications systems.

It is thus important to develop techniques that will be able to reduce these undesirable phenomena.

The so-called "localized waves" (LW), which are also known as non-diffractive waves, have the property of withstanding diffraction for a long distance in free space, propagating with only slight dispersion. Today, concept of localized waves is well consolidated both from a theoretical standpoint and from an experimental standpoint, and localized waves are applied successfully in innovative applications both in a medium that in a vacuum, featuring a good resistance to dispersion.

Systems that use localized waves can find valid application in investigation at a distance for identifying buried objects, such as, for example, in the sectors of archaeology, minesweeping, long-distance wireless power transmissions, anticrash systems, electromagnetic propulsion systems, molecular-excitation systems for conservation of quantum angular momentum, for safe medium-distance communications, etc.

The most important and peculiar part of a localized-wave system is constituted by the radiating structure (antenna). Radiating structures are typically obtained by means of one of the following configurations: shields with circular slits impinged upon by plane waves, recollimated by means of lenses; arrays of appropriately phased acoustic emitters (transducers); electromagnetic radiators made with multimodal waveguide; "axicons" (optical components with at least one conical surface); and holographic elements.

So far, considerable attention has been dedicated to application of localized waves to systems operating in the optical and acoustic domains. In the field of microwaves there has been an attempt to imitate optical configurations, and the technological developments have been slowed down by the need to use radiating structures that are dimensionally very large (given that the overall dimensions of said radiating structures are determined by the wavelength of the electromagnetic signal applied to the radiating structure).

These radiating structures are, consequently, costly and cumbersome to produce.

DISCLOSURE OF INVENTION

The aim of the present invention is to provide a slotted waveguide antenna that will be able to overcome the drawbacks of the known art, and in particular an antenna for generating non-diffractive waves that can be applied in the microwave field.

According to the present invention a slotted waveguide antenna is provided, as defined in the annexed claims.

BRIEF DESCRIPTION OF THE DRAWINGS

For a better understanding of the present invention, preferred embodiments thereof are now described, purely by way of non-limiting example and with reference to the attached drawings, wherein.

BEST MODE FOR CARRYING OUT THE INVENTION

Figure 1:
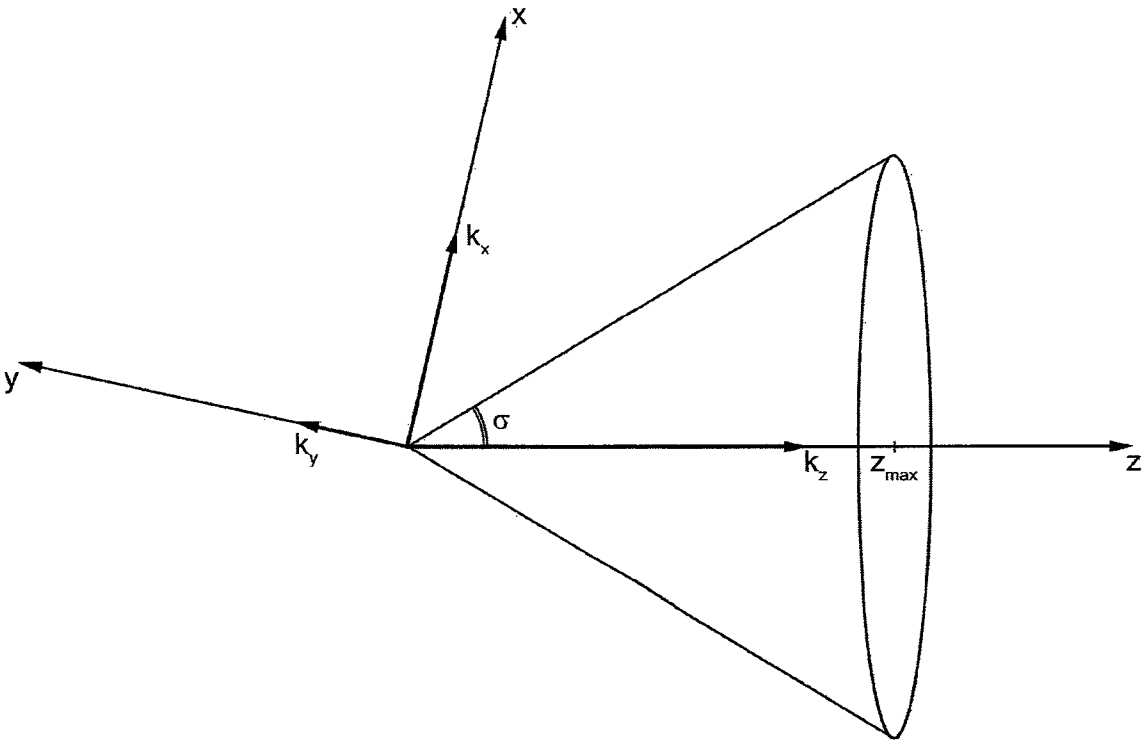
FIG. 1 shows a Bessel beam, i.e., the distribution on a conical surface of the wave vectors of the plane waves that make it up.

According to the present invention, a slot antenna is provided formed, as described in detail hereinafter, by two parallel disks or plates facing one another and set at a distance from one another, and supplied by an electromagnetic radiofrequency (microwave) signal at a central portion of the antenna itself, between the two disks. These disks may be viewed as a parallel-plane waveguide, supplied at the origin. Since these disks form circular planes in which the centre of feed coincides substantially with the centre (or, in general, centroid) of the disks, the structure thus formed is a radial waveguide. In use, the antenna according to the present invention operates as a guiding structure in which the radiofrequency signal appropriately injected at the centre propagates radially towards the periphery. The antenna according to the present invention is designed to generate, on its surface, a field that can be described as a Bessel function (or a number of Bessel functions). For this purpose, the antenna has a plurality of slots cut into its surface to form a curvilinear pattern (comprising, for example, one or more spirals or concentric circles) that interact with the radiofrequency signal that propagates inside the antenna, generating a signal emitted by the antenna having characteristics that are proper to a Bessel function. In particular, the summation of the energy irradiated by each of said slots towards the outside of the antenna performs the synthesis of the field distribution (or of equivalent currents on the surface of the top disk) to form an irradiated field that can be described as a Bessel function.

In particular, according to the present invention, a slot antenna with circular aperture is provided comprising: a radial waveguide, including an upper plate and a lower plate, which are made of conductive material and are set facing one another; a dielectric layer extending between the upper plate and the lower plate; and a signal feeder. The upper plate, which in particular has a circular shape, has a centroid and is delimited externally by an edge region, and comprises a plurality of radiating apertures formed as slots in the upper plate and arranged between the centroid and the edge region according to an ideal curvilinear pattern (in particular a spiral). First radiating apertures of said plurality of radiating apertures are arranged along a first portion of said ideal curvilinear pattern to form a first radiating region, and are separated from one another in a radial direction joining in a rectilinear way the centroid with a point of the edge region (radial direction), by a first distance. Second radiating apertures of said plurality of radiating apertures are arranged along a second portion of the ideal curvilinear pattern to form a second radiating region. The second radiating apertures are separated from one another, in the radial direction considered previously, by a second distance (for example, equal to the first distance). Extending between the first radiating region and the second radiating region is a zero-radiation region without radiating apertures having an extension, in the radial direction considered previously, equal to a third distance greater than the first and second distances. The signal feeder is configured for supplying the first and second radiating regions with an electromagnetic field having, in the first radiating region, a first phase value, and, in the second radiating region, a second phase value opposite to the first phase value.

According to an embodiment of the present invention, the electromagnetic field supplied to the antenna is a circularly polarized wave.

According to a further embodiment of the present invention, the electromagnetic field supplied to the antenna is of a uniform type. It is here recalled that an electromagnetic wave is defined s "uniform" when the isophase and isoamplitude surfaces coincide. Defined as "isophase surfaces" are those surfaces in which the phase is constant; defined as "isoamplitude surfaces" are those surfaces in which the modulus of the wave is constant. Instead, when the amplitude of the oscillations varies with the direction, and hence on the isophase surface (spherical surface in the example treated) it is not constant, the wave is not defined as "uniform". In either case, there remains a damping of the wave, the greater the distance from the origin O.

The main advantage of the antenna according to the present invention is that it irradiates a localized wave, which can be described as a Bessel beam and possesses the characteristics of a Bessel beam, i.e., that is affected to a minimal extent by phenomena of diffraction and dispersion even at great distances.

An ideal case of wave without diffraction and dispersion is constituted by the infinite plane wave, which, however, is physically non-realizable. Stratton, in 1941 (J. A. Stratton: Electromagnetic Theory, McGraw Hill, N.Y., 1941, Sect. 5.12), derived a monochromatic solution of the wave equation centred on its axis of propagation with a transverse profile and having the shape of a Bessel function (or Bessel beam). Said function is, however, associated to an infinite power flow, which is in practice non-realizable. In 1987 a heuristic solution was derived by reducing the transverse dimension of the beam by means of a radiating aperture of finite dimensions.

The present applicant has found experimentally that if a Bessel beam, having a wavelength $\lambda_0$=0.6328 μm and a beam width (or radius of the spot) $\rho_0$=59 μm, is made to pass through an aperture of radius R=3.5 mm, it propagates for approximately cm without modifying its characteristics. If, instead, a similar Gaussian beam is used, it is noted that the transverse width of the beam doubles after only 3 cm, and that after 6 cm its intensity decreases by a factor of 10.

It thus follows that a Bessel beam can travel approximately without deformation for a distance many times greater than a similar Gaussian beam. In theory, it is deemed that Bessel beams are non-diffractive in the ideal case of infinitely large radiating apertures, i.e., when their depth of field is infinite.

For a better understanding of the present invention, described in what follows are the characteristics that identify a Bessel beam, from a theoretical standpoint.

The Bessel beam is identified by a central portion (or central spot) having high intensity, surrounded by a theoretically infinite number of annular portions (rings) containing the same amount of energy as the central portion, but having a lower intensity than that of the central portion. In fact, since each ring contains the same amount of energy as the central portion, the greater the radius of the respective ring, the lower its intensity.

Starting from the known differential equation, or homogeneous wave equation, (1) expressed in cylindrical coordinates ρ, Φ, z, (for simplicity, limited to solutions in axial symmetry)

$$\left(\frac{\partial^2}{\partial\rho^2}+\frac{1}{\rho}\frac{\partial^2}{\partial\rho^2}+\frac{\partial^2}{\partial z^2}-\frac{1}{c^2}\frac{\partial^2}{\partial t^2}\right)\varphi(\rho,z;t)=0 \quad (1)$$

a Bessel beam with axial symmetry can be expressed according to the particular solution given by Equation (2)

$$\phi(\rho,z;t)=J_0(k_\rho\rho)\cdot e^{i(k_z z-\omega t)} \quad (2)$$

where $J_0(k_\rho\rho)$ is a zero-order Bessel function, ω is the angular frequency, ρ is the radial co-ordinate, z is the direction of propagation, whilst $k_z$ and $k_\rho$ are, respectively, the longitudinal and radial wave numbers. The term "e" is the known Napier's constant.

In said form, the Bessel beam is an "ideal" beam, which propagates with an unaltered transverse field structure, and with a central spot of radius $\Delta\rho=2.4/k_\rho$, in any spatial position thereof. The ideal beam possesses, as has been said, an infinite depth of field. Unfortunately, generation of an ideal Bessel beam would require an infinite aperture, and hence would entail an infinite flow of power through a transverse surface. For practical applications it is thus necessary to truncate the beam.

FIG. 1 shows, by way of example, an axially symmetrical Bessel beam generated by the superposition of plane waves the wave vectors of which lie on the surface of a cone having its axis of symmetry that coincides with its axis of propagation coinciding, and angle equal to θ (which is referred to as "axicon angle"). The field is concentrated around the axis of propagation z.

When the Bessel beam is truncated by means of a finite circular aperture of radius R (such that R>>Δρ), it assumes a finite depth of field $Z_{max}$, given by Equation (3)

$$Z_{max}=R/\tan(\theta) \quad (3)$$

where, as has been said, θ is the axicon angle of the Bessel beam, which depends upon the longitudinal and transverse wave numbers through Equations (4) and (5):

$$k_z=\omega/c\cdot\cos(\theta) \quad (4)$$

$$k_\rho=\omega/c\cdot\sin(\theta) \quad (5)$$

In the region $0<z<Z_{max}$ and $0<\rho<(Z_{max}-z)\cdot\tan(\theta)$, the applicant has found that the truncated Bessel beam can be well approximated by the ideal solution according to Eq. (2) given above.

However, when the aperture (in this example, a circular aperture to obtain the truncated beam) has a radius R that does not obey the relation R>>Δρ (i.e., the radius R of the aperture of emission of the beam is much greater than the radius Δρ of the central spot desired for the beam), it is not possible to state with certainty that the field remains non-diffractive in the aforementioned region, and much less that in said region the field can be approximated by the expression of the ideal Bessel beam. In the above circumstance, it is possible to obtain analytical solutions in the Fresnel approximation, or by means of numeric simulations (of a type in itself known), based upon the diffraction integral, to obtain the field irradiated by the finite aperture.

When a Bessel beam is truncated, since it acquires a finite depth of field, the lateral regions of the beam undergo a degradation during propagation. However, the essential characteristic of non-diffractive beams is that they have an extensive focus; i.e., they maintain their central spot and their transverse shape substantially unaltered for a long distance.

A Bessel beam, unlike a Gaussian beam, presents a high field concentration (high intensity) not in a punctiform focus, but along a focal line extending in the direction of propagation. The Bessel beam does not concentrate its own energy in a transverse direction in a single spot, but conveys energy also in the side rings. In fact, each Bessel beam is reconstructed, along its own path, precisely by the energy coming from the side rings, external to the central spot, which evolve along conical surfaces and constitute the transverse structure of the beam. In the spot of a Bessel beam the high field intensity is preserved for a large depth of field. This characteristic is of particular importance, for example, for remote-sensing applications, if, for example, the gain on the level of the "clutter" is considered (in applications of signal transmission in open environment, the "clutter" is constituted by the signal reflected by the ground in a random and non-coherent way and hence presents as a signal that has the same frequency as that of the transmitted signal and rapidly varies in amplitude and phase over time). The effects of the clutter introduce a signal having a markedly variable level and phase, which increases the noise of the receiving channel and hence degrades the sensitivity of the receiver and the performance of the sensor system. In a conventional antenna, the solution becomes a function of the distance. Instead, for Bessel beams, to the extent in which the operating depth of field is the one whereby the cross section of the beam is preserved, the solution that is obtained is independent of the distance. This entails the advantage that also the clutter is kept constant as the distance of observation varies.

Figure 2A:
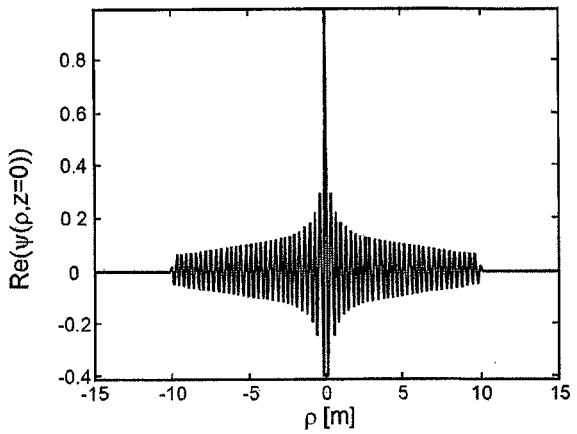
FIGS. 2*a*-2*c* show, respectively: the real component of a Bessel beam generated by an antenna with finite circular aperture in the plane of the aperture itself; the intensity of the field at the aperture; and the intensity in three-dimensional view of the irradiated field.
Figure 2B:
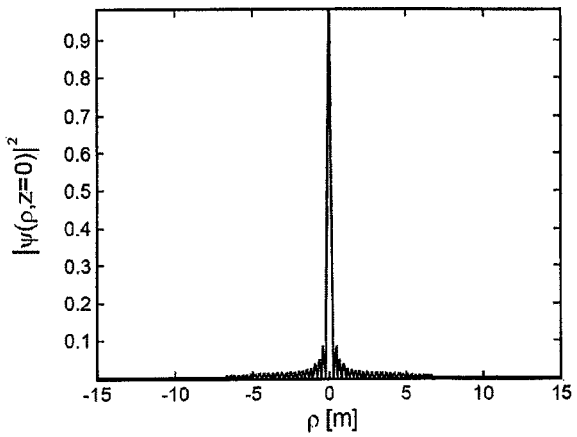
Figure 2C:
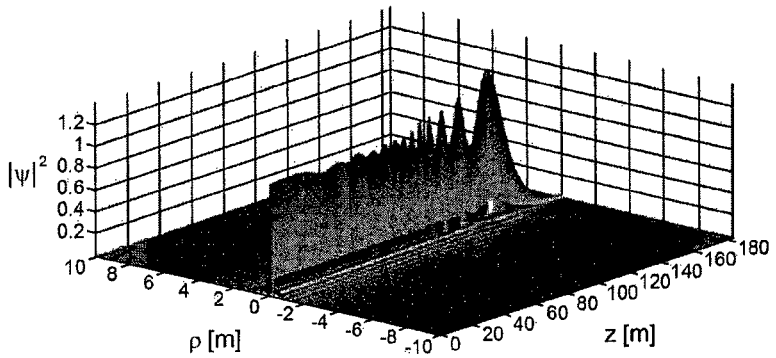

There now follows a treatment of the characteristics of a Bessel beam truncated by a radiating aperture of finite size. As first example, a Bessel beam with axicon angle θ=0.062 rad, frequency of 15 GHz, and a central spot with radius Δρ=12 cm is considered. The Bessel beam is assumed as being truncated by a finite circular aperture of radius R=10 m. In this case that the irradiated field is expected to be approximately given by Eq. (2) in the region defined by $0<z<Z_{max}$ and $0<\rho<(Z_{max}-z)\cdot\tan(\theta)$, with $Z_{max}=161.1$ m approximately. FIGS. 2a-2c show: the real component of the field at the aperture, in z=0 (FIG. 2a); the intensity of the field at the aperture (FIG. 2b); and the intensity, in three-dimensional view, of the irradiated field. It is pointed out that the radius $\Delta\rho$ of the central spot is, for the purposes of the present description, the distance, starting from $\rho=0$ (in the transverse direction), at which the first zero of the intensity of the field is located. It could alternatively be possible to adopt as radius of the spot the distance from the origin of the point where its intensity drops by a factor 1/e (where "e" is Napier's constant, $e\approx2.71$). In this second case the initial spot of the Bessel beam would have a radius $\Delta\rho(z=0)=7$ cm.

Figure 3A:
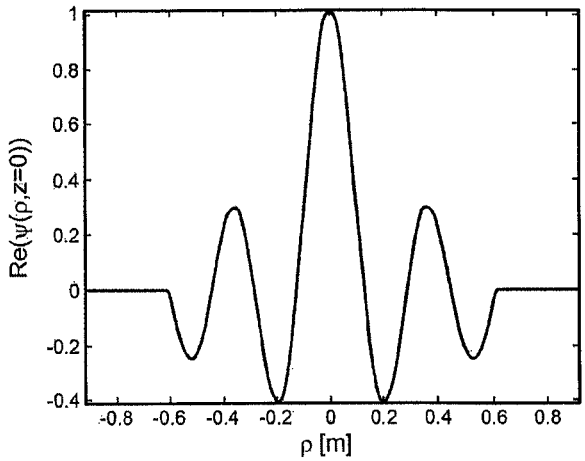
FIGS. 3*a*-3*c* show, respectively: the real part of a Bessel beam generated by an antenna with finite circular aperture of much smaller size than the aperture according to FIGS. 2*a*-2*c*; the intensity (in square modulus) of the Bessel beam itself; and the intensity in three-dimensional view of the irradiated field.
Figure 3B:
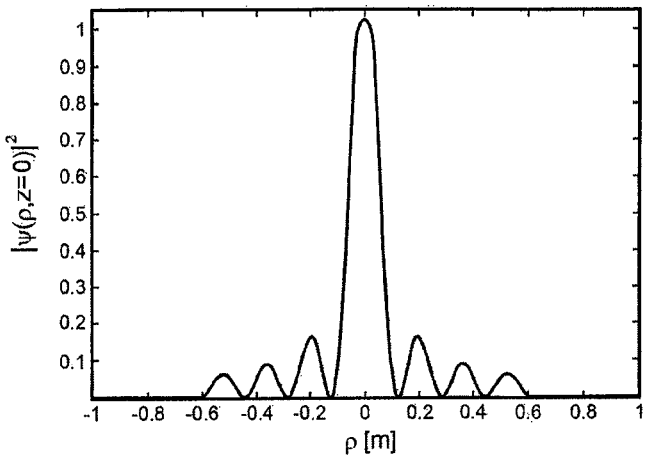
Figure 3C:
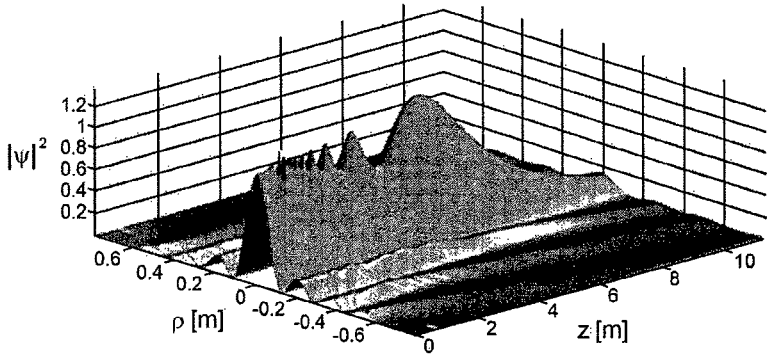

There now follows a description of the effect of a truncation of the beam by means of an aperture of dimensions smaller than that of the previous example, for instance, a circular aperture of radius R=61 cm. Using the expression $Z_{max}=R/\tan(\theta)$ for calculating the depth of field, a value $Z_{max}$ equal to 9.8 m would be obtained. FIGS. 3a-3c show the behaviour of a Bessel beam truncated by a circular aperture of radius R=61 cm, which is too small for the requirements of a non-diffractive beam. FIG. 3a shows the real part of the field at the aperture (z=0); FIG. 3b shows the intensity (in square modulus) of the Bessel beam itself; and FIG. 3c shows the intensity, in three-dimensional view, of the irradiated field.

In this case, in addition to the central spot, only three annular regions (or intensity rings) "survive" truncation.

From FIGS. 3a-3c it may be noted that the field starts to undergo an intense decay (typical of truncated non-diffractive beams) at a distance $Z_{max}$ shorter than 9.8 m, in particular approximately 6 m. In addition, the intensity side rings show a significant degradation even before this distance. This occurs because the reduced number of intensity rings (as has been said, only three) are unable to reconstruct the central spot at the distance $Z_{max}$.

Figure 4B:
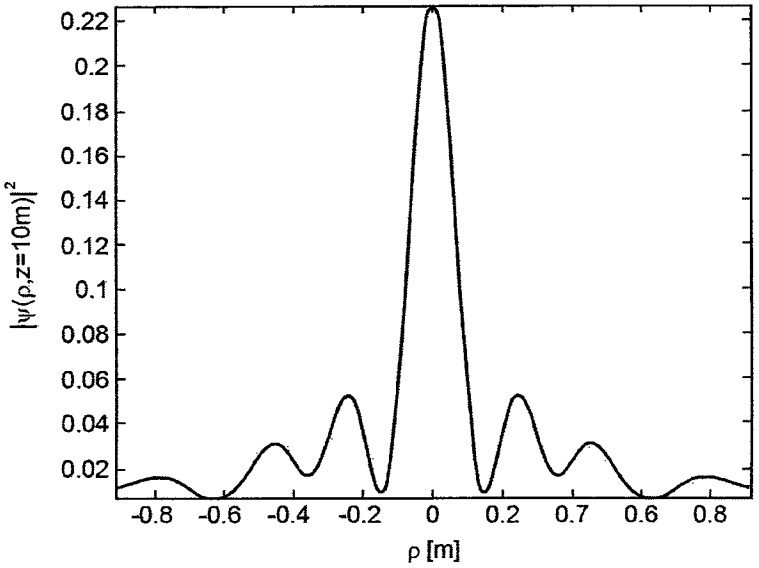
FIGS. 4*a* and 4*b* show the transverse profile of intensity at the aperture and, respectively, at a distance from the aperture during propagation of the Bessel beam according to FIGS. 3*a*-3*c;*
Figure 4A:
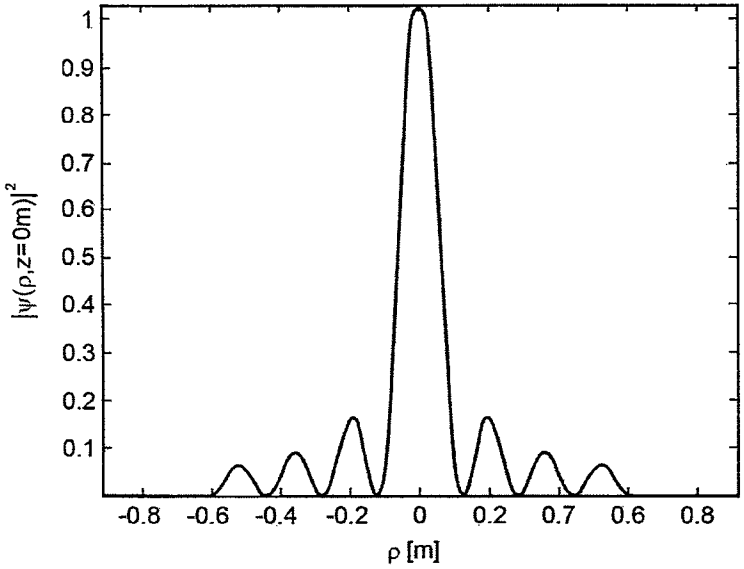

From FIGS. 3a-3c, it may be noted, however, that, even though the beam will start its decay before $Z_{max}=R/\tan(\theta)=9.8$ m, and more precisely starting from z=6 m, the width of its central spot is kept substantially unaltered also for greater distances. FIGS. 4a and 4b show the transverse profile of intensity in z=0 m and in z=10 m, during propagation of the beam of FIGS. 3a-3c. The intensity of the central spot, after 10 m, decays by approximately ¼ of its initial value, but its radius undergoes very little alteration, with $\Delta\rho(z=0\text{ m})$ equal to approximately 12 cm, and $\Delta\rho(z=10\text{ m})$ equal to approximately 15 cm.

In conclusion, then, even though the Bessel beam previously described with reference to FIGS. 3a-3c is markedly truncated, it is still able to maintain for relatively long distances (FIGS. 4a, 4b) the spatial shape of its central spot (albeit not its intensity).

Figure 5:
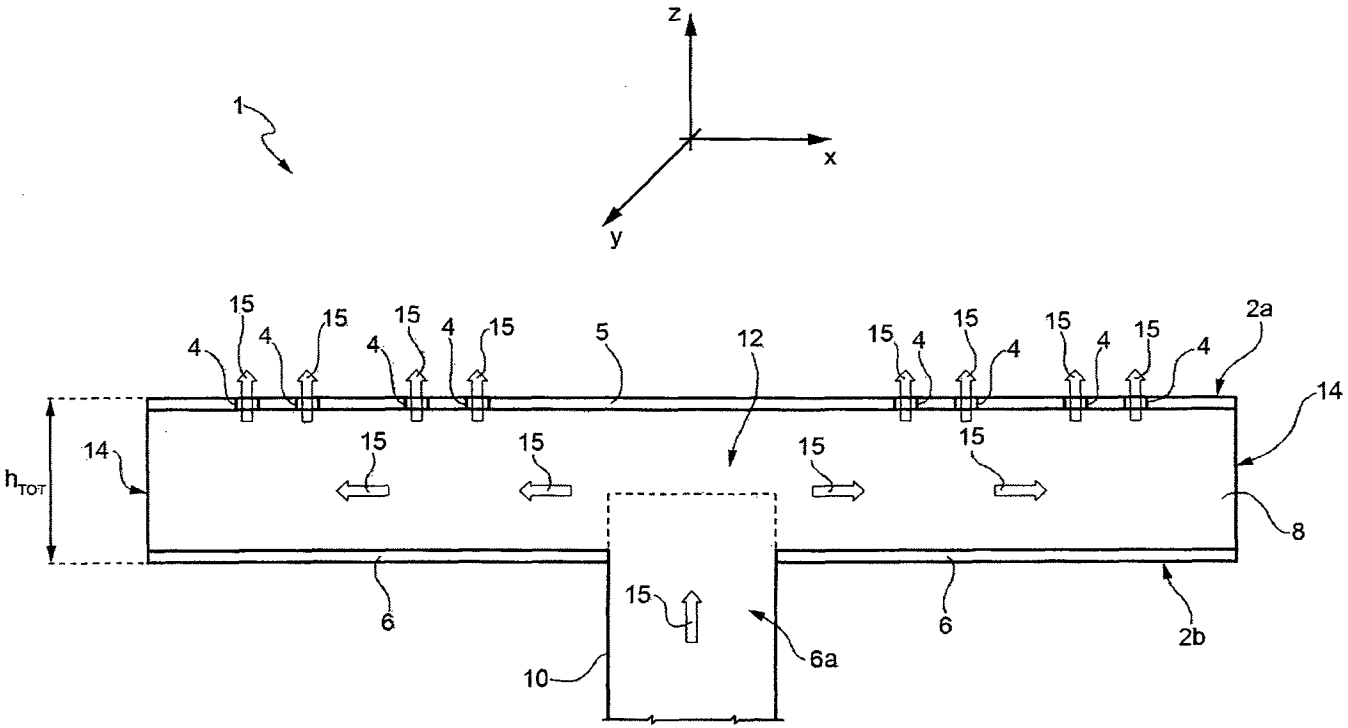
FIG. 5 shows, in cross-sectional view, a slot antenna according to one embodiment of the present invention.

FIG. 5 shows, in cross-sectional view, an antenna 1 according to one embodiment of the present invention. The antenna 1 of FIG. 5 is moreover visible, in top view according to one embodiment, in FIG. 8 (which shows an enlarged detail) and in FIG. 10a (which shows the antenna 1 as a whole).

The antenna 1 is an antenna for near-field focalization of electromagnetic radiation. More in particular, the antenna 1 is a low-profile antenna of the type with an array of radiating elements (known as "Radial Line Slot Array"—RLSA). In this context, "low profile" means "electrically thin", in so far as it is formed (as illustrated in greater detail in what follows) by two facing plates between which a guided propagation takes place in a way similar to what occurs in a parallel-plane waveguide, with specific reference to a waveguide of a radial type. The distance between the surfaces is in the region of a quarter of wavelength $\lambda$ of the electromagnetic signal applied between the upper plate and the lower plate.

The antenna 1 comprises a top surface 2a and a bottom surface 2b, opposite to one another and arranged on respective planes parallel to one another. An array of radiating elements 4 is formed on the top surface 2a; each radiating element 4 is substantially a slot cut into the top surface 2a.

The antenna 1 basically provides a slotted waveguide. In particular, the antenna 1 comprises an upper plate 5 and a lower plate 6, made of conductive material, for example metal, set parallel to one another and at a distance from one another. The top surface 2a is hence the exposed surface of the upper plate 5, and the bottom surface 2b is the exposed surface of the lower plate 6. Set between the upper plate 5 and the lower plate 6 is a dielectric layer 8, for example made of rigid polymethacrylimide foam having a dielectric constant $\in_{r1}=1.07$. With this material, the thickness $h_{tot}$ of the antenna 1 is, for example, comprised between approximately 3.5 mm and 6.5 mm, in particular 4.4 mm. Other materials may in any case be used having a dielectric constant approximately equal to $\in_{r1}$.

The antenna 1 forms a waveguide with plane and parallel plates (upper plate 5 and lower plate 6). The upper plate 5 houses the array of radiating elements 4 (also referred to as "slots"), cut through the entire thickness of the upper plate 5.

The antenna 1 further comprises a feed probe 10, set in a position corresponding to a central portion 6a of the lower plate 6 and configured for supplying a signal in a central region 12 of the antenna 1, comprised between the upper plate 5 and the lower plate 6. In this way, a power associated to the signal supplied is transferred symmetrically in a wave that travels radially from the central region 12 towards side edges 14 of the antenna 1 (see the arrows 15 in FIG. 5). The radiating elements 4 are hence excited by a travelling wave with rotational symmetry. The radiating elements 4 are formed in the upper plate 5 with an arrangement chosen on the basis of the type of polarization and of the mode of excitation in the guide. In the case of circular polarization and of fundamental mode in the parallel-plate waveguide (PPW), the radiating elements 4 are set along a spiral. The arrangement and dimensions of the radiating elements 4 determine the distribution of phase and amplitude of the currents on the radiating elements 4 themselves.

Figure 6:
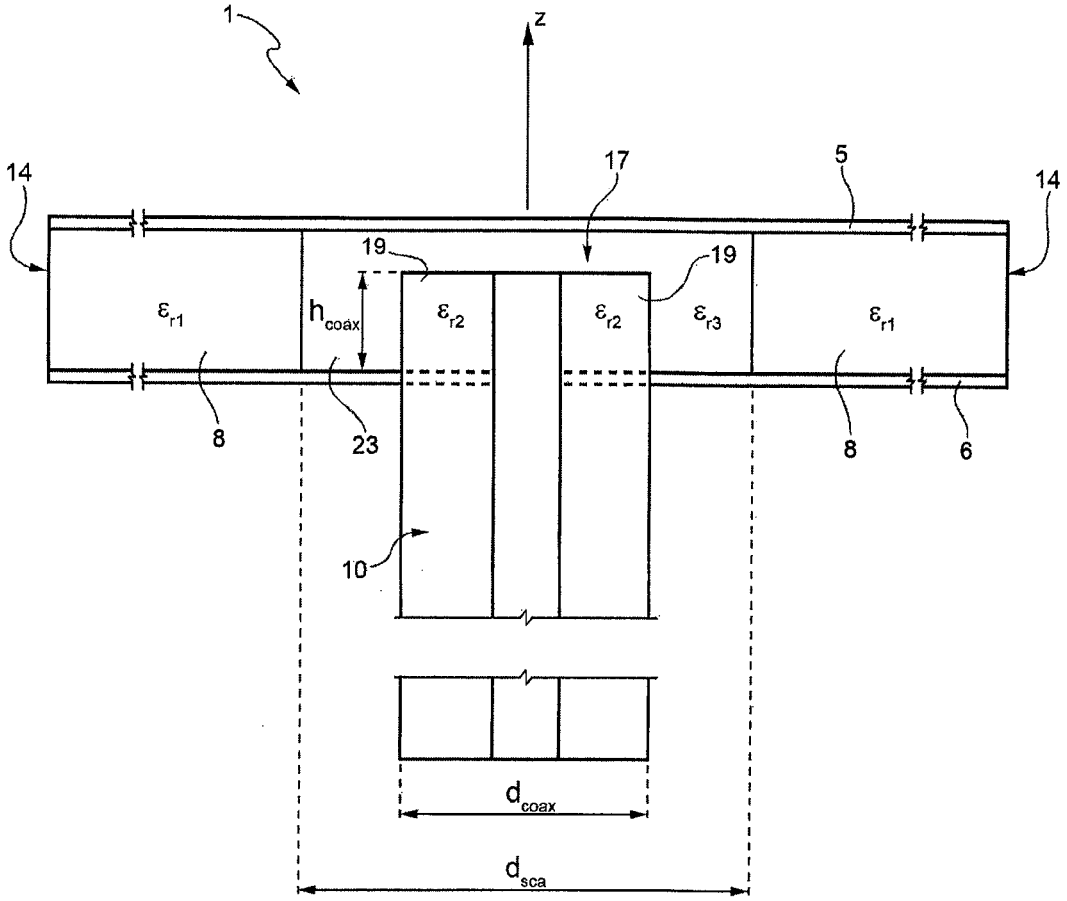
FIG. 6 shows, in cross-sectional view, a more detailed embodiment of the antenna of FIG. 5.

FIG. 6 shows the same cross-sectional view as that of FIG. 5, which represents more clearly a matching network 17 for matching the feed probe 10 to the parallel-plate guide formed by the upper plate 5, the lower plate 6, and the dielectric layer 8.

The matching network 17 comprises, according to one embodiment, a first dielectric region 19, having a dielectric constant $\in_{r2}$ of approximately 2.1, which forms a cylindrical region that surrounds the portion of the feed probe 10 that penetrates between the upper plate 5 and the lower plate 6 (and possibly, for practicality of production, also the portion of the feed probe 10 external to the antenna 1). The first dielectric region 19 has, as has been said, a substantially cylindrical shape with a height $h_{coax}$ equal to the depth with which the feed probe 10 penetrates within the antenna 1, for example approximately 3.55 mm, and a diameter of the circular base $d_{coax}\approx4.06$ mm.

A second dielectric region 23, having a dielectric constant $\in_{r3}$ approximately equal to 1, surrounds the first dielectric region 19 laterally and at the top. Also the second dielectric region 23 has, for example, a cylindrical shape with a base diameter $d_{sca}$ of approximately 10 mm. The height of the second dielectric region 23 depends upon the thickness $h_{tot}$ of the antenna 1, and upon the thickness of the upper plate 5 and lower plate 6 of the antenna 1. The second dielectric region 23 has, in any case, a height equal to the distance between the side of the upper plate 5 and the side of the lower plate that face one another. Extending outside the second dielectric region 23, between the upper plate and the lower plate 5, 6, is the dielectric layer 8, as previously described.

Figure 7:
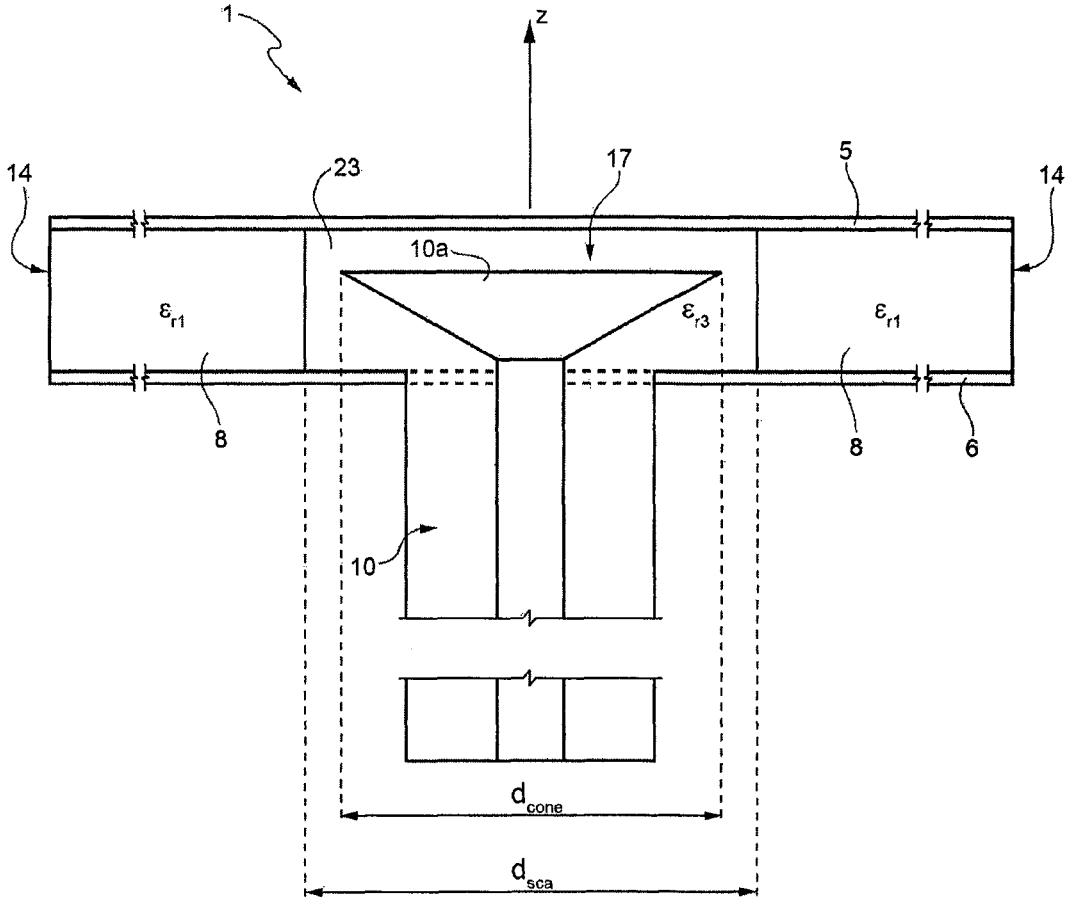
FIG. 7 shows, in cross-sectional view, a more detailed embodiment of the antenna of FIG. 5 alternative to the embodiment of FIG. 6.

According to a further embodiment, shown in FIG. 7, the feed probe 10 comprises a terminal portion 10*a* (extending at least partially within the antenna 1, between the upper plate 5 and the lower plate 6) having a substantially conical shape with a height $h_{cone}$ of, for example, 3.2 mm. The feed probe 10 extends within the antenna 1 for a depth of approximately 3.7 mm. The cone has a base diameter $d_{cone}$ of approximately 9.4 mm. According to this embodiment, the first dielectric region 19 is not present, and the portion of the feed probe 10 that extends within the antenna 1, between the upper plate 5 and the lower plate 6 (in practice the terminal portion 10*a*) is completely surrounded by just the second dielectric region 23. The second dielectric region 23, with dielectric constant $\in_{r3}$ equal to 1, has a cylindrical shape similar to the one described previously, and has a base diameter $d_{sca}$ of approximately 10 mm.

Figure 8:
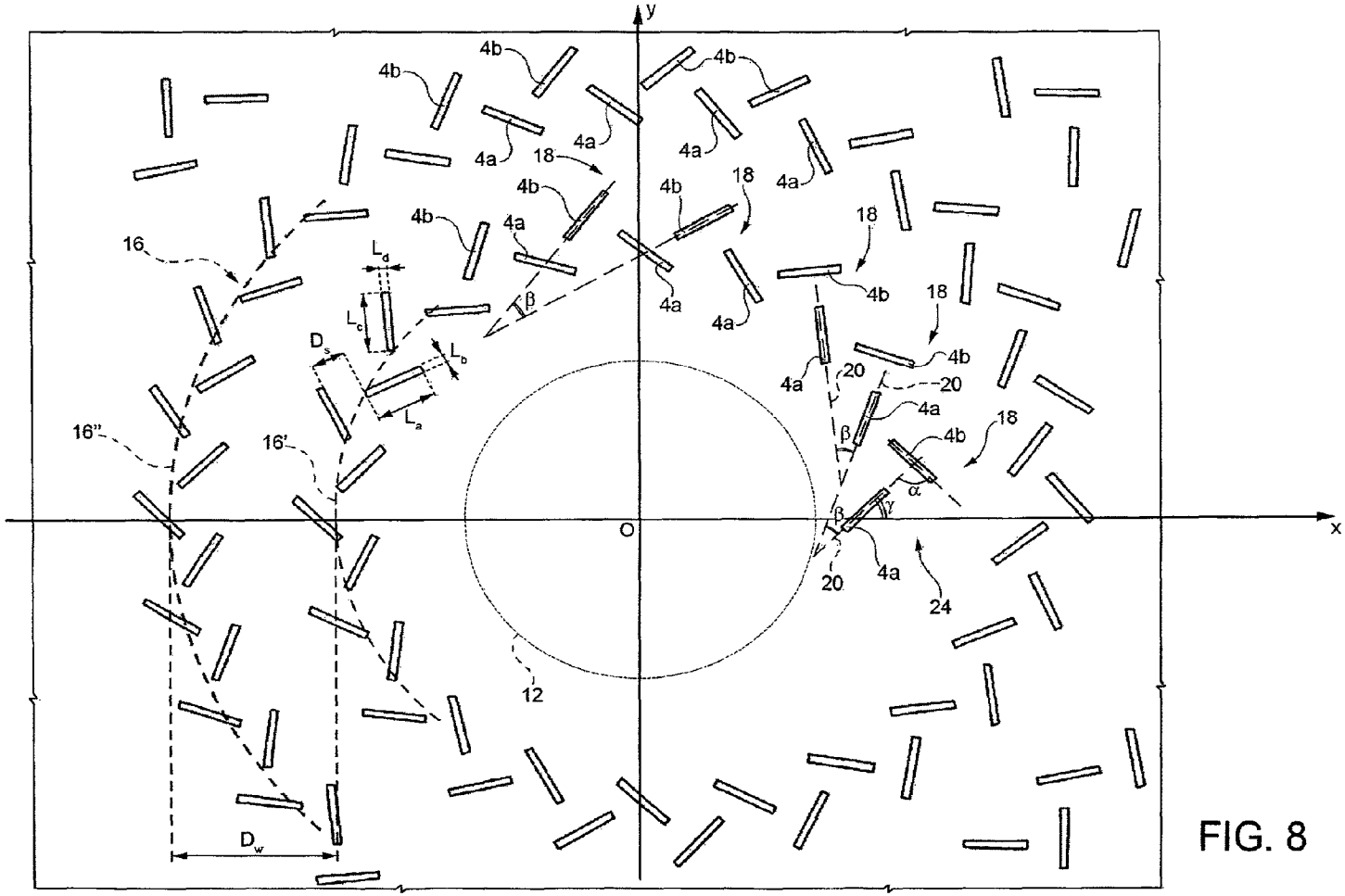
FIG. 8 shows a detail of a central portion of the antenna of FIG. 5 in top view.

FIG. 8 shows, in top plan view, an enlarged detail of a portion of the upper plate 5 taken in an area corresponding to the central portion 12, visible in which are some radiating elements 4 and the corresponding arrangement.

The radiating elements 4 are set in pairs 18, where each pair 18 comprises a first groove 4*a* and a second groove 4*b*.

For each pair 18 of radiating elements 4, the first groove 4*a* is set in a first direction 20 and the second groove in a second direction 21. The first and second directions 20, 21 define, in a point of intersection thereof, an angle $\alpha$ of approximately 90°.

Figure 10A:
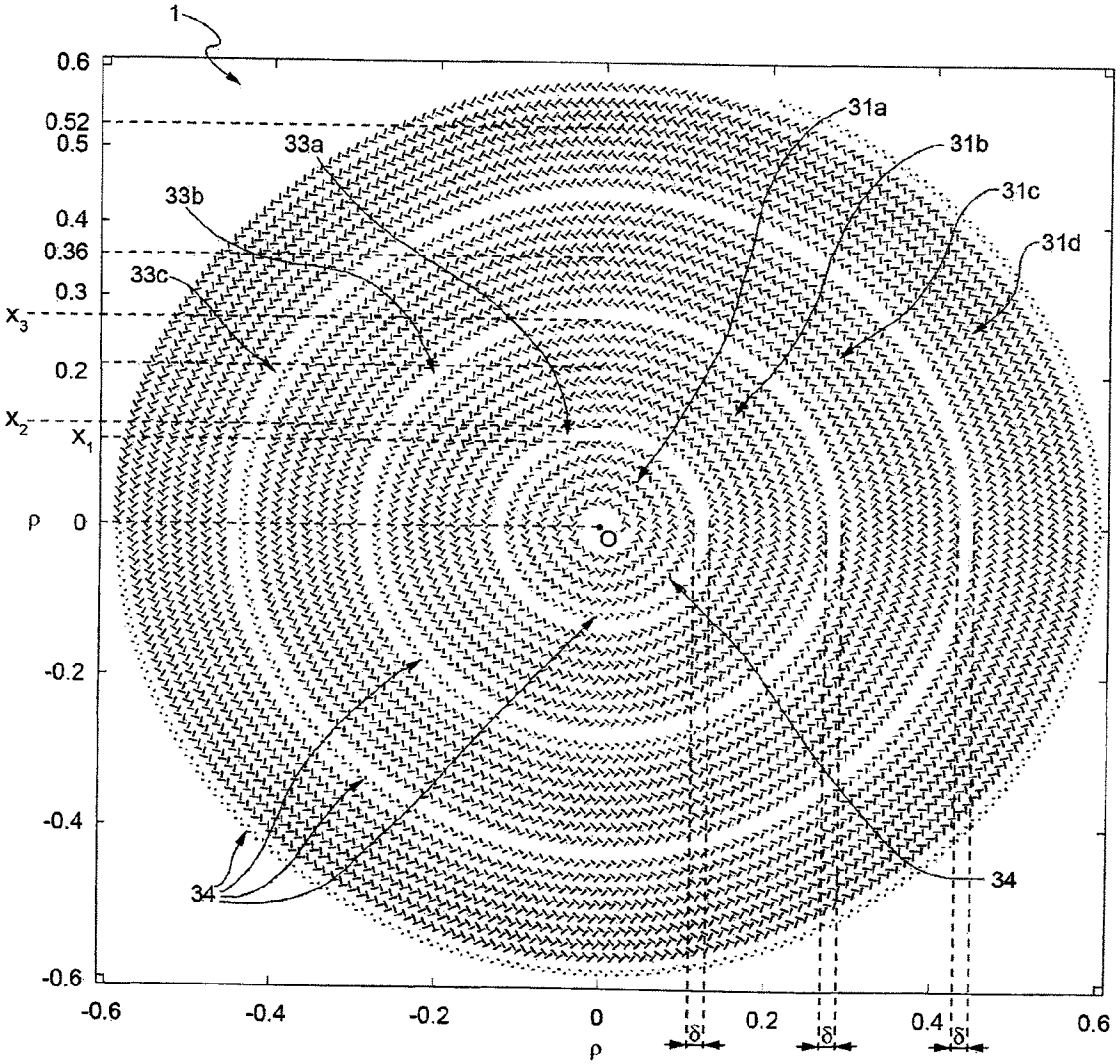
FIG. 10*a* shows, as a whole and in top plan view, the slot antenna comprising a plurality of radiating apertures arranged to form a spiral, according to one embodiment of the present invention.

Each pair 18 of radiating elements 4 is set alongside another pair 18 of radiating elements 4 along an ideal line that forms a spiral 16 (which is represented dashed only partially in FIG. 8, and may be better appreciated as a whole in FIG. 10*a*). In the sequel of the description, for simplicity, referred to as "spiral 16" is the overall set of the radiating elements 4 (including first and second grooves 4*a*, 4*b*) set along the (ideal) line of the spiral 16. The spiral 16 is formed by a plurality of coplanar turns (two turns 16' and 16", immediately following one another, are partially shown in FIG. 8). The distance $D_W$ between the two turns 16' and 16" in a radial direction (for example, along the axis X—note that in the present description the spatial axes are designated by uppercase letters) is, for example, equal to approximately one wavelength $\lambda$, in the specific example approximately 2.1 cm.

According to one embodiment of the present invention, the spiral 16 is an Archimedean spiral, also known as "arithmetic spiral". Mathematically, an Archimedean spiral is the curve described by a point the distance of which from the centre (pole) remains proportional to the amplitude of the angle covered during the displacement. In this case, the distance $D_W$ between the two turns 16' and 16" remains constant throughout the spiral 16.

Note that according to different embodiments, the distance $D_W$ can vary as the radial distance from the centre O (or, in general, centroid O) of the antenna 1 increases.

As may be noted from FIG. 8, the radiating elements 4 (first and second grooves 4*a* and 4*b*) are set in an area corresponding to the dashed line that defines the spiral 16 but does not lie exactly on it. They are, instead, set with a certain angle with respect to the ideal line of the spiral 16 (said angle is defined on the basis of the angle $\gamma$ of the first groove 4*a* formed at the point of start 24 of the spiral 16, as described more fully hereinafter).

First grooves 4*a* arranged immediately one after another along one and the same turn 16' or 16" of the spiral 16 thus formed, are rotated with respect to one another in a counterclockwise direction through an angle $\beta$ that varies with the distance from the centre, where it is approximately 26.2°, reaching approximately 1° on the outer periphery of the antenna (in the proximity of the outer edge 14). The variation of the angle $\beta$ is, for example, linear along the entire development of the spiral. Likewise, also the second grooves 4*b* arranged along one and the same turn and immediately following one another, are rotated with respect to one another in a counterclockwise direction by the same angle $\beta$. The spiral 16 hence evolves in the counterclockwise direction starting from the point of start 24 that is close to the central region 12 of the antenna (basically, with reference to FIGS. 6 and 7, starting from the region of boundary between the dielectric region 23 and the dielectric layer 8). The angle $\gamma$ formed between the axis X and the first direction 20 of the first groove 4*a* set in a position corresponding to the point of start 24 of the spiral 16 is approximately 45°.

The first grooves 4*a* have, in top plan view, a substantially rectangular shape, with major side $L_a$ (in what follows, length) of a variable value (in particular a value that increases along the spiral from the central region 12 towards the side edges 14 of the antenna 1), and minor side $L_b$ (in what follows, width) of a substantially fixed value.

Likewise, also the second grooves have, in top plan view, a rectangular shape, with major side $L_c$ (in what follows, length) of a variable value and minor side $L_d$ (in what follows, width) of a fixed value. According to one embodiment, the width $L_b$, $L_d$ of the first and second grooves 4*a*, 4*b* has the same value.

For example, the value of $L_a$ and $L_c$ is the same for each pair of first and second grooves 4*a* and 4*b*, for instance comprised between approximately 2 mm and approximately 10 mm. The minimum value of $L_a$ and $L_c$ is assumed by the first and second grooves 4*a*, 4*b* that are set at the point of start 24 of the spiral 16; hence, the value of $L_a$ and $L_c$ increases linearly along the development of the spiral 16 until it assumes the maximum value envisaged. The width $L_b$ and $L_d$ of the first and second grooves 4*a*, 4*b* is chosen of a fixed value, for example comprised between 0.5 mm and 1.5 mm, in particular approximately 0.9 mm.

The distance $D_s$ between a first groove 4*a* and a second groove 4*b* belonging to one and the same pair 18 is substantially the same for all the pairs 18 belonging to the spiral and is approximately equal to the height of the antenna $h_{tot}$ 4.4 mm.

The antenna 1 according to the present invention, in one embodiment, satisfies the following requirements: the relative impedance-matching band is preferably greater than 6% and is centred on the operating frequency of 15 GHz; the maximum power managed is equal to or higher than 10 W peak; the impedance matching is lower than −20 dB, referred to 50Ω; the diameter of the antenna 1 is approximately 1200 mm; the polarization is a left-hand circular polarization.

Figure 9:
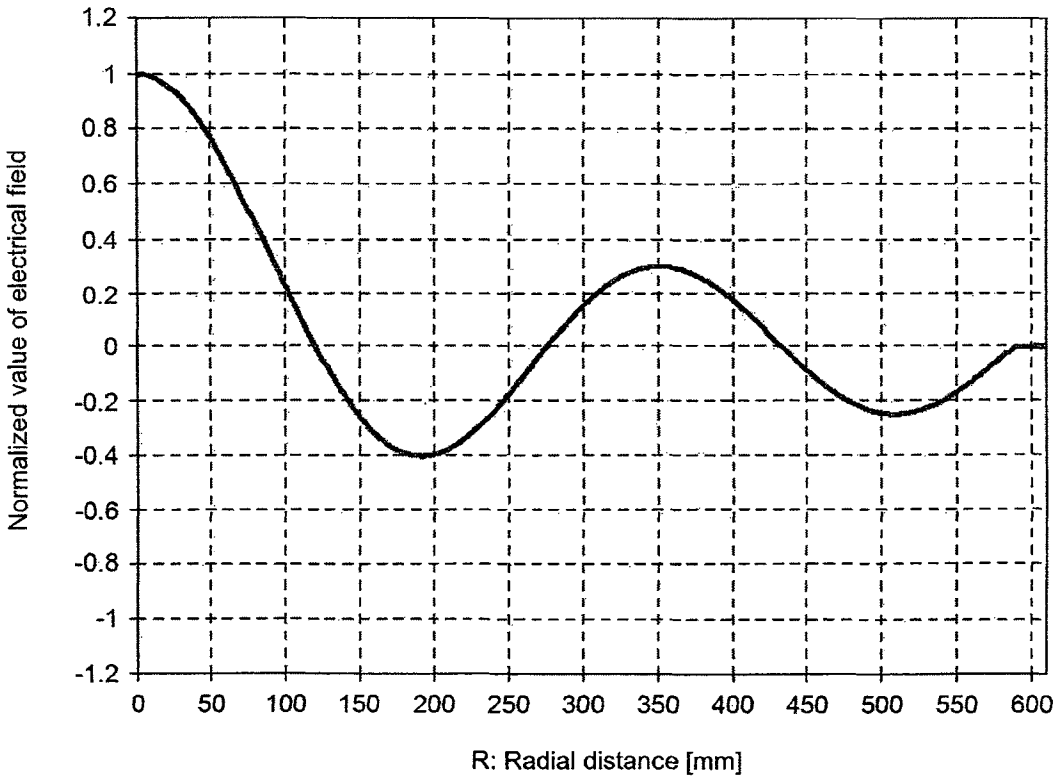
FIG. 9 shows a function that represents the desired pattern of the irradiated electrical field, in which the maximum value of the electrical field is normalized as much as possible on the radiating aperture of the antenna of FIG. 8.

According to one embodiment, the field distribution, normalized with respect to its maximum value, on the radiating aperture with cylindrical symmetry and radial profile is given by the Bessel function $J_0(k_\rho R)$, where $k_\rho=20$ [l/m], and R is the radial distance, in meters, from the geometrical centre O of the antenna 1. The function that represents said field distribution is shown in FIG. 9, which illustrates the value of the electrical field normalized with respect to the maximum on the radiating aperture.

Figure 16:
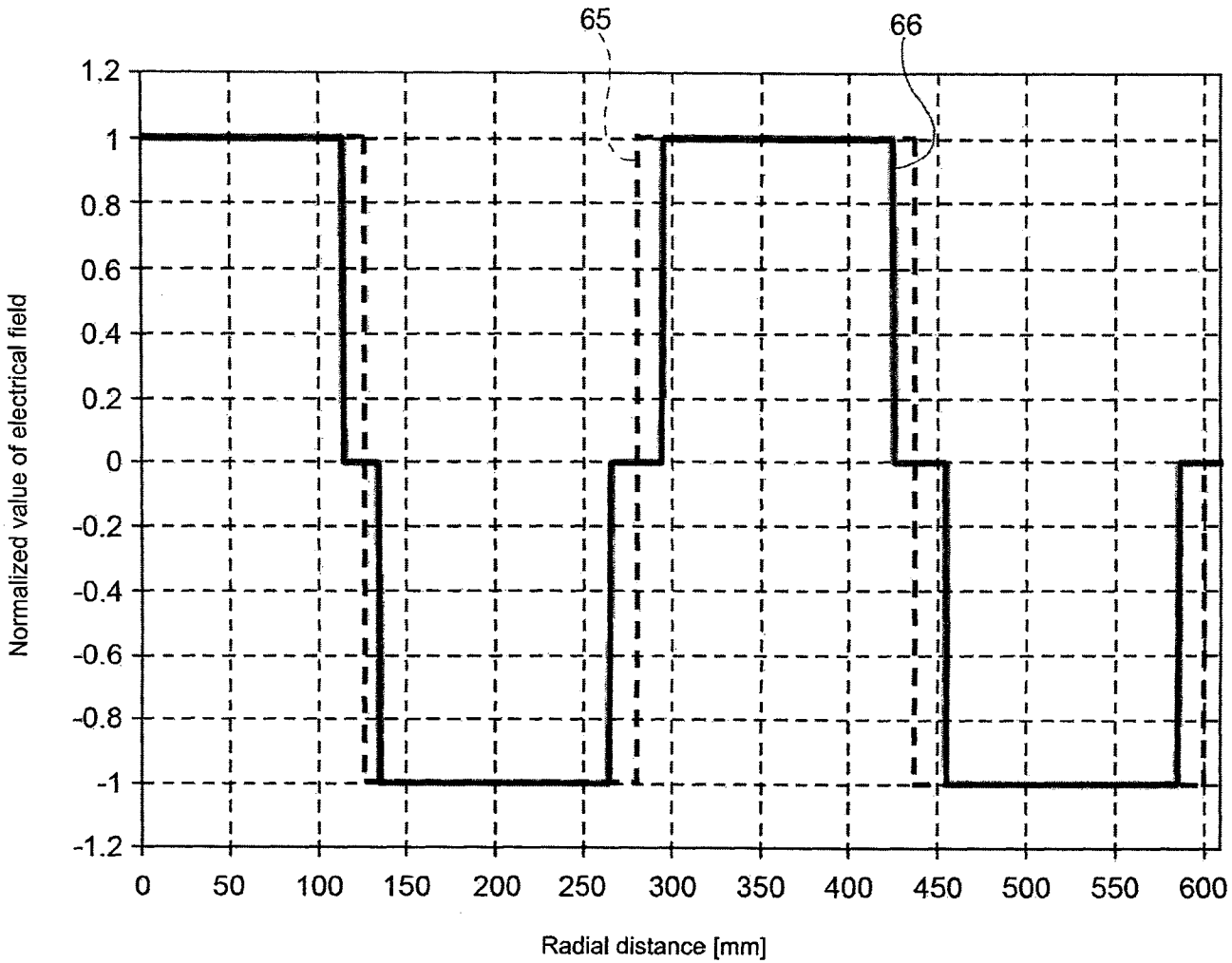
FIG. 16 shows an oscillating function that represents the distribution of the field, normalized with respect to its maximum value, on the radiating aperture of the antenna of FIG. 15.

According to a further embodiment, the field distribution, normalized with respect to its maximum value, on the radiating aperture with cylindrical symmetry and radial profile is determined by the oscillating function of the type shown in FIG. 16. FIG. 16 shows the value of the electrical field normalized with respect to the maximum on the radiating aperture.

As regards the requirement of focalization, the electrical field generated is circularly polarized, and the corresponding Poynting vector is directed along the axis z normal to the radiating aperture in an approximately ellipsoidal region. The −3 dB region of the focalization area in the dimensions x and y does not exceed 120 mm.

As regards the choice of the configuration, focalization is obtained at a greater distance given the same intensity of electrical field in the focalization point.

The geometrical dimensions chosen for the antenna 1 impose a diameter of the antenna of approximately 60λ at the central frequency, thus determining a number of radiating elements 4 of approximately 9000.

More in particular, the field distribution of the type shown in FIG. 9 is obtained by an antenna 1, having a circular shape with a diameter of 1202 mm, on the upper plate 5 of which 9202 radiating elements 4 are obtained having a minimum length $L_a$, $L_c$ of 2 mm and a maximum length $L_a$, $L_c$ of 9.5 mm (which increases linearly along the development of the spiral 16). The width $L_b$, $L_d$ of each slot is chosen of a fixed value, equal to 0.9 mm. According to this embodiment, the return loss at 15 GHz introduced by the radiating elements 4 is −42 dB, and the radiation efficiency is 96.9%. The field distribution of FIG. 9 is obtained by means of an antenna 30 of the type shown in FIG. 10*a*.

Figure 10B:
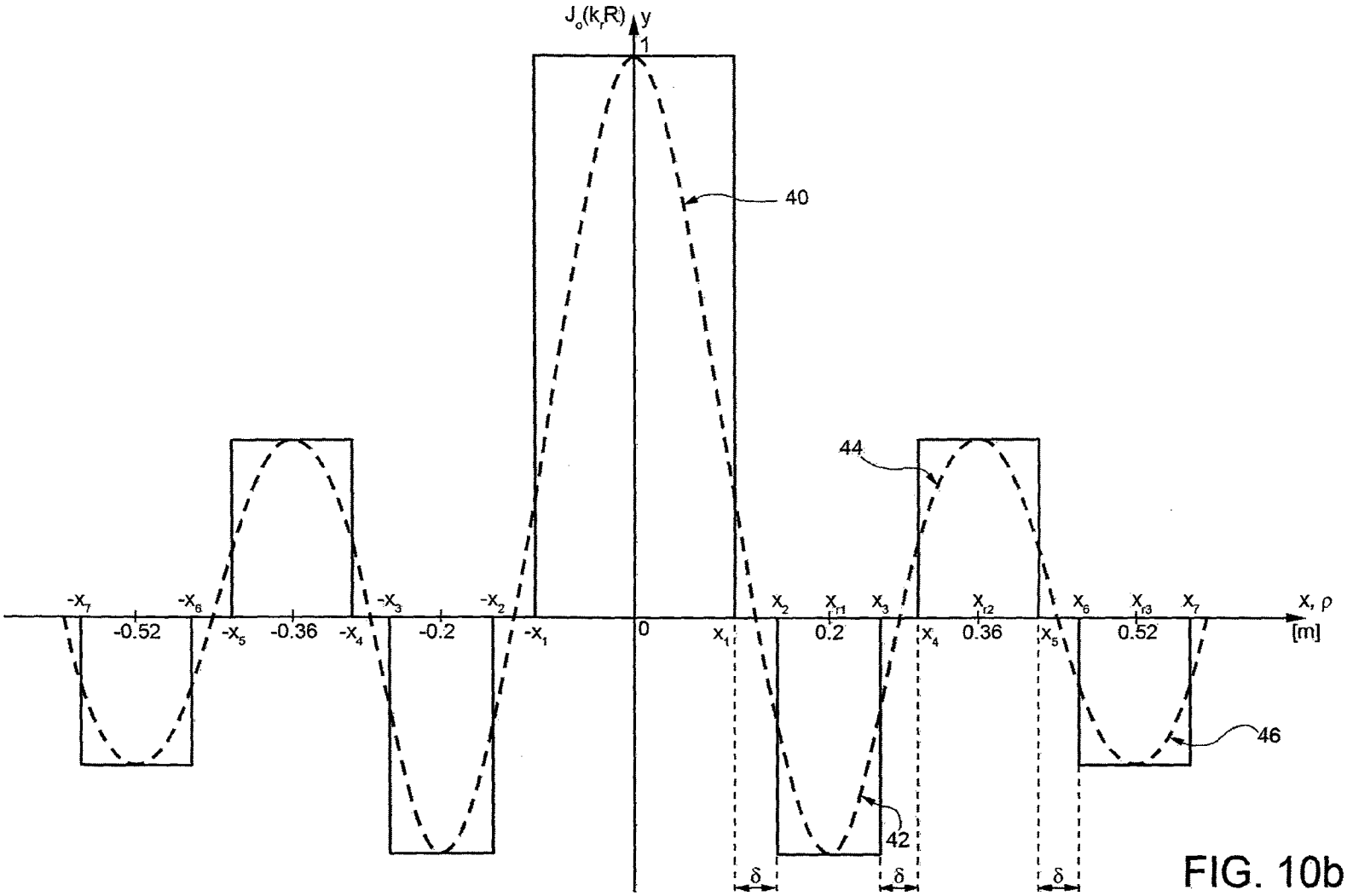
FIG. 10*b* shows, with a dashed line, the curve of FIG. 9 (desired Bessel beam) and, with a solid line, a stepwise function that defines the spatial position of the radiating apertures of the antenna of FIG. 10*a* and the amplitudes (alternatively positive and negative)

FIG. 10*b* shows, with a dashed line, the curve of FIG. 9 (which is a Bessel function $J_0(k_\rho R)$) and, with a solid line, a stepwise function that discretizes the function $J_0(k_\rho R)$. Said stepwise function defines the spatial arrangement, on the antenna 1, of the radiating elements 4 in a plurality of blocks 31*a*-31*d*. Each block 31*a*-31*c* is radially separated from another block 31*b*-31*d* radially adjacent thereto by a respective dwell region 33*a*-33*c* (in what follows referred to also as "zero-signal region" 33*a*-33*c*).

The plot, along the vertical axis of FIG. 10*b*, determines also the ratios between the amplitudes of the distribution of equivalent currents to be applied to each of said blocks 31*a*-31*d*, according to one embodiment. For example, the signal supplied to the antenna 1 through the input port 10 is an oscillating electromagnetic signal (or field) that propagates radially within the flat-parallel-plate waveguide formed by the antenna 1 (i.e., between the upper plate 5 and the lower plate 6). The position and distribution of the slots (radiating elements) 4, as per the previous description, is such as to intercept part of the energy that flows in the flat-parallel-plate waveguide, sending it out (through the upper plate 5), and then irradiating it according to the distribution in position, phase, and intensity shown in FIG. 10*b*. Hence, at each block 31*a*-31*d*, between the upper plate 5 and the lower plate 6 of the antenna 1, an electromagnetic field propagates, the intensity of which, transferred on the plane external to the upper plate 5, follows the ratio between the amplitudes of the fields as determined by the discretized Bessel function $J_0(k_\rho R)$.

The antenna of FIG. 10*a* comprises a plurality of turns arranged in four blocks 31*a*, 31*b*, 31*c*, 31*d* separated from one another by a respective zero-signal region 33*a*, 33*b*, 33*c*. The distance, measured in a radial direction, for example along the axis X, between the last turn belonging to a block 31*a*-31*c* and the first turn belonging to the radially subsequent block 31*b*-31*d* is greater than the radial distance $D_W$ that separates immediately successive turns, in the radial direction considered, belonging to one and the same block 31*a*-31*d*.

The radial distance $D_W$ between turns belonging to one and the same block 31*a*-31*d* may differ from the radial distance $D_W$, in the same radial direction considered, between turns belonging to another one and the same block 31*a*-31*d*.

Each block 31*a*-31*d* comprises radiating elements 4 that are wound according a respective spiral 16, which is an Archimedean spiral. In this case, within one and the same block 31*a*-31*d* the distance $D_W$ remains constant as the radial distance from the centre O of the antenna 1 increases.

The transition between the Archimedean spiral of one block 31*a*, 31*b*, 31*c* and the Archimedean spiral of the next block 31*b*, 31*c*, 31*d* is obtained via transition grooves 34, having smaller dimensions than the grooves 4*a*, 4*b* immediately preceding (belonging to the immediately preceding block) and immediately subsequent (belonging to the immediately subsequent block). In general, the transition grooves 34 may also be omitted. The dimension (length, width) of the transition grooves 34 is, for example, equal to a fraction (for example, half) of the dimension (length, width) of the last groove belonging to the block 31*b*-31*c* that precedes the start of the region of transition between one block 31*a*-31*d* and another.

The passage from the radiating elements 4 belonging to one of the blocks 31*a*, 31*b*, 31*c*, 31*d* to the radiating elements 4 that form the transition grooves 34 may be sharp (the reduction in length is immediate) or else progressive (the radiating elements 4 progressively reduce in length until they reach the length envisaged for the transition grooves 34). In any case, the spatial evolution of the transition grooves 34 is not an Archimedean spiral. What has been said applies in a similar way for the reverse transition, i.e., for the passage from the radiating elements 4 that form the transition grooves 34 to the radiating elements 4 belonging to the subsequent block 31*b*, 31*c*, 31*d*. Transition grooves 34 are also present in a terminal portion of the outermost turn of the block 31*d* (the turn radially furthest from the centre of the antenna 1), and have the function of reconstructing the central part of the beam.

With reference to FIG. 10*a*, the antenna 1 has a circular aperture and, owing to the presence of the radiating elements 4 as described previously, is designed to generate, in use, a signal that approximates a Bessel beam with axicon angle θ=0.062 rad, frequency of 15 GHz, spot Δρ=12 cm. The truncation envisaged is that of a circular aperture with radius R=61 cm.

According to the embodiment of FIG. 10*a*, the blocks 31*a*-31*d* are located between the consecutive zeros of the Bessel function that it is desired to generate (the latter is shown, as has been said, in FIG. 10*b* with a dashed line).

As has already been said, the radiating elements 4 are set according to Archimedean spirals (each block 31*a*-31*d* forms a respective Archimedean spiral) that extend radially between successive roots (points where the Bessel function assumes the zero value) of the Bessel function $J_0(k_\rho R)$. It is recalled that an Archimedean spiral in polar co-ordinates has the form given by Eq. (6)

$$\rho=a+b\Phi \tag{6}$$

where "a" and "b" are constant.

In the case of the antenna 1, since a plurality of Archimedean spirals are present between consecutive roots of the Bessel function $J_0(k_\rho R)$, we will have one equation for each Archimedean spiral $$\rho=\rho_{0i}+b_i\Phi \text{ for } \rho_{0i}\leq\rho\leq\rho_i-\delta/2 \tag{7}$$

where the subscript "i" identifies the i-th spiral (where i=1 indicates the spiral of the block 31*a*, i=2 the spiral of the block 31*b*, i=3 the spiral of the block 31*c*, i=4 the spiral of the block 31*d*); δ is, as shown in FIGS. 10*a* and 10*b*, the radial distance of the area of transition between the end of one spiral and the start of the next spiral (in FIG. 10*b* it is the distance on the axis p between discretization windows of the Bessel function immediately following one another); $\rho_{0i}$ is the point considered of start of the corresponding i-th spiral ($\rho_{01}$ is substantially the point of start 24 shown in FIG. 8); $\rho_{0i}$, with i>1, is given by $\rho_{0i}=\rho_{(i-1)}+\delta/2$.

The values $\rho_i$ are the roots of the Bessel function given by $J_0(k_\rho\rho_i)=0$.

With reference to Eq. (7), the values of $b_i$ are given by $$b_i=\frac{(\rho_i-\delta/2)-(\rho_{i-1}+\delta/2)}{2m_i\pi}=\frac{\rho_i-\rho_{i-1}-\delta}{2m_i\pi} \tag{8}$$

where $m_i$ is the number of turns of the i-th spiral (or, equivalently, the number of turns of the i-th spiral) in the interval $\rho_{0i}\leq\rho\leq\rho_i-\delta/2$.

The spirals are thus characterized that, with a single turn (m=1), function as region of transition between adjacent blocks 31*a*-31*d* (the transition grooves 34), i.e., the spirals (or individual turns) that extend in the region $(\rho_i-\delta/2)\leq\rho\leq(\rho_i+\delta/2)$. They are given by the functions:

$$\rho=\rho_{0i}'+c_i\Phi \tag{9}$$

where $\rho_{0i}'=\rho_{0i}-\delta/2$.

The value of $w_e$ is obtained from:

$$c_i=\frac{(\rho_i+\delta/2)-(\rho_i-\delta/2)}{2\pi}=\frac{\delta}{2\pi} \tag{10}$$

By varying the value of δ the characteristics of the beam that is emitted are varied. Per unit length of the spirals that form the blocks 31*a*-31*d* there exists a fixed number of pairs of slots 4*a*, 4*b*. This is sufficient to determine easily where to place the pairs of slots 4*a*, 4*b* along the spirals.

On the basis of what has been set forth herein it is thus possible to build antennas 1 of the type described previously starting from a desired function for the Bessel beam that they are to generate.

With reference to FIGS. 10*a* and 10*b*, the physical parameters of the antenna 1, for one embodiment of the present invention, are listed in what follows. The maximum value of the central spot 40 corresponds to the centre O of the antenna 1 (centre of the axes X and Y). The (negative) maximum of the first ring 42 is reached at the distance $x_{r1}$, measured on the positive axis X (equivalent to the axis ρ), equal to $x_{r1}=\pi(1+1/4)/k_\rho=0.20$ m. The (positive) maximum of the second ring 44 is reached at the distance $x_{r2}$, measured on the positive axis X, equal to $x_{r2}=\pi(2+1/4)/k_\rho=0.36$ m. The (negative) maximum of the third ring 46 is reached at the distance $x_{r3}$, measured on the positive axis X, equal to $x_{r3}=\pi(3+1/4)/k_\rho=0.52$ m. The width of the central spot 40 has been approximated, between $-x_1$ and $x_1$, to a value of 0.23 m. The amplitudes of the first, second, and third rings 42, 44, 46 have been approximated between, respectively, $x_2$ and $x_3$, $x_4$ and $x_5$, $x_6$ and $x_7$, by values that are the same as one another and equal to 0.13 m. The interval between $x_1$ and $x_2$ (of a value of 0.021 m) defines an area in which the Bessel function considered assumes a value around zero, which can be approximated by zero. Likewise, the interval between $x_3$ and $x_4$ and the interval between $x_5$ and $x_6$ (both having a value of 0.034 m) define respective areas where the Bessel function considered assumes a value around zero, which can be approximated by zero.

As may be noted graphically from FIGS. 10*a* and 10*b*, the aforementioned values are used for defining the geometrical dimensions of the antenna 1, of the blocks 31*a*-31*d*, and of the zero-signal regions 33*a*-33*c*. The width, in top plan view along positive values of the axis X (starting from the centre O of the antenna 1), of the block 31*a* is approximately equal to $x_1=0.115$ m; the width, in top plan view along positive values of the axis X, of the block 31*b* is equal to $x_3-x_2=0.13$ m; the width, in top plan view along positive values of the axis X, of the block 31*c* is equal to $x_5-x_4=0.13$ m; and the width, in top plan view along positive values of the axis X, of the block 31*d* is equal to $x_7-x_6=0.13$ m.

The numeric values of the amplitudes of the fields on each block 31*a*-31*d* are given by the values of the peaks of the Bessel function considered. It may be noted that, since the amplitudes alternate passing from positive to negative values, at each change of block 31*a*-31*d* there is a change of phase of 180° of the signal with respect to the previous block.

In particular, when the signal supplied to the antenna 1 via the input port 10 is a wave that travels radially from the central internal region 12 towards the side edges 14 of the antenna 1, it is necessary to respect the condition previously set forth for the external equivalent currents (on the radiating apertures 4), i.e., the alternation of n radians of the phase passing from one block 31*a*-31*c* to the next block 31*b*-31*d*. Said condition is optimized once the positions, lengths, and angles of the slots 4 have been defined as described previously. This condition is moreover represented by way of example in Table 1 below.

TABLE 1

| Block 31a-31d considered | Phase of the signal on the slots (rad) |
|---|---|
| Block 31a | 0 |
| Block 31b | π |
| Block 31c | 0 |
| Block 31d | π |

It is evident that, by varying significantly the wavelength X of the supply signal with respect to the wavelength envisaged for the specific application, the spatial arrangement of the blocks 31*a*-31*d* on the upper plate 5 of the antenna 1 must be modified in such a way as to guarantee always the condition set forth previously, in particular according to Table 1.

The signal supplied to the antenna 1 via the input port 10 may be of any type (impulsive signal, square-wave signal, sinusoidal signal, modulated signal, etc.). The Bessel beam generated by the antenna 1 has characteristics of the signal supplied at input (impulsive, modulated, etc.), but moreover possesses the peculiar and desired characteristics of a Bessel beam. The condition according to Table 1 is not to be interpreted in a rigid way, in the sense that the signal must change phase immediately at start of each block 31*a*-31*d*, or at the end of the previous block 31*a*-31*c*. In particular, the change of phase of $\pi$ is evaluated at the point of maximum amplitude (peak amplitude) assumed by said signal in each block 31*a*-31*d* with respect to the corresponding point in which said signal reaches a value of maximum amplitude in the previous (or subsequent) block 31*a*-31*d*.

In what follows, as units of measurement, arbitrary units (a.u.) will be used, which correspond to volts per meter for the most common case of the electrical field, to amps per meter for the magnetic field, and to watts per square meter for the Poynting vector. The numeric values of field in each block 31*a*-31*d* are given in what follows. As regards the block 31*a*, the field at the centre O of the antenna 1 is $\Psi_0=1$ a.u.; as regards the block 31*b*, the field at the distance $x_{r1}$ is $\Psi_1=J_0(k_\rho r_1)=-0.4026$ a.u.; as regards the block 31*c*, the field at the distance $x_{r2}$ is $\Psi_2=J_0(k_\rho r_2)=0.3001$ a.u.; and, as regards the block 31*d*, the field at the distance $x_{r3}$ is $\Psi_3=J_0(k_\rho r_3)=-0.2497$ a.u.

Figure 11:
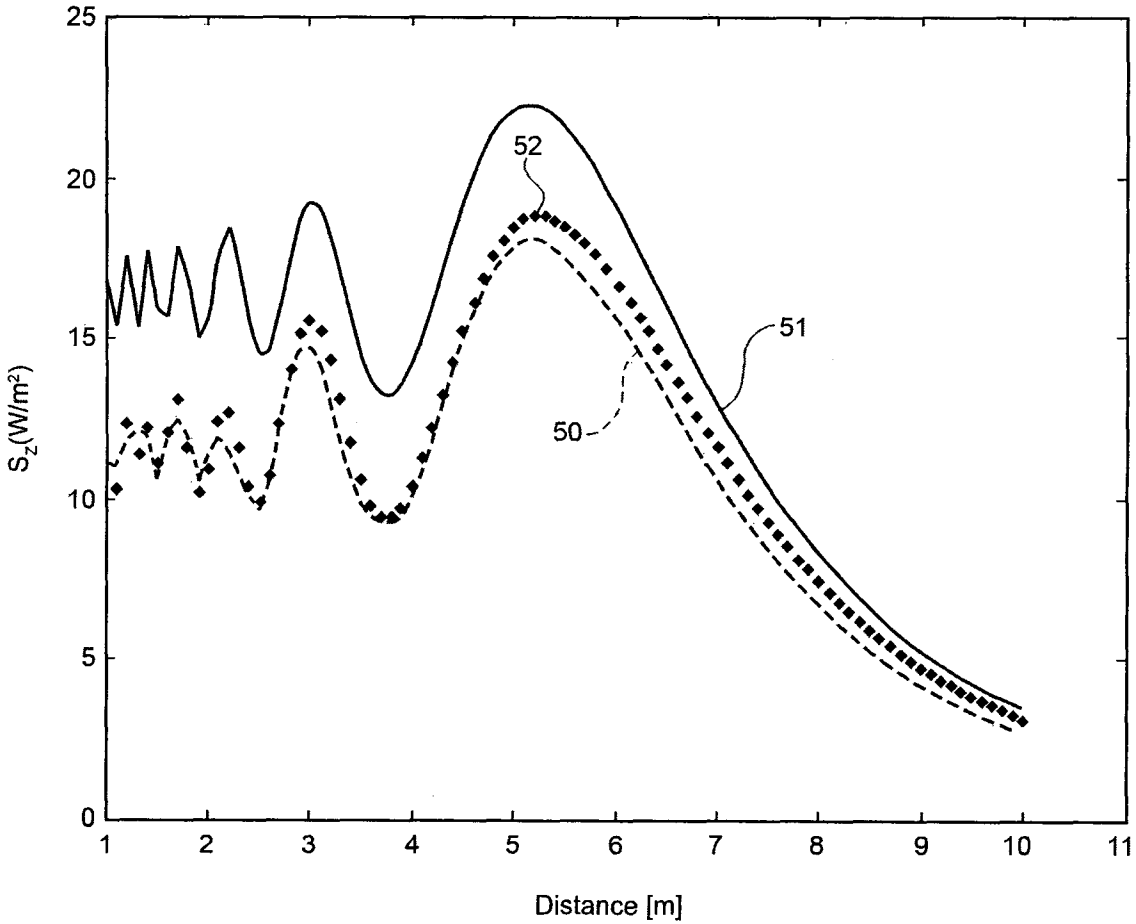
FIG. 11 shows, superimposed on one another: a curve of the profile of the power density irradiated (Poynting vector along z) by the antenna of FIG. 10*a*; a curve of a similar distribution in the limit case of ideal d.c. current; and a curve of a similar ideal distribution sampled on the positions of the radiating apertures of the antenna of FIG. 10*a;*

FIG. 11 shows the profile of the density of power irradiated along the central axis perpendicular to the plane of the antenna 1 (i.e., passing through the centre O of the antenna 1, parallel to the axis z) for an antenna 1 synthesized according to what is described with reference to the present invention, in particular to the embodiment of FIGS. 8 and 10*a*.

The three curves 50, 51, 52 represent the cases given hereinafter. Curve 51: analytical theoretical curve. It is the one resulting from an ideal antenna structure with continuous surface-current distribution, according to a Bessel function. Curve 52: sampled theoretical curve. It is the one resulting from an ideal antenna structure with sampled surface-current distribution, according to the same Bessel function as that of the curve 51. Curve 50: sampled real synthesized curve. It is the one resulting from a real antenna structure with sampled surface-current distribution, according to the same Bessel function, using an antenna of the type described previously.

The power accepted by the antenna 1 is assumed as being of 1 W. In the ideal case, the focalization length is $z_i=5.2$ m, at which the radiated power density is equal to $S_{z_i}=22.28$ W/m$^2$. However, if sampling of the aperture is taken into account, and associated to each pair 18 of radiating elements 4 is a current equal to the ideal one sampled for each pair 18 of radiating elements 4, we obtain $z_i=5.3$ m and $S_{z_i}=18.87$ W/m$^2$. Finally, in the real case of the synthesized antenna 1, we have $z_p=5.2$ m and $S_{z_p}=18.11$ W/m$^2$.

Figure 12A:
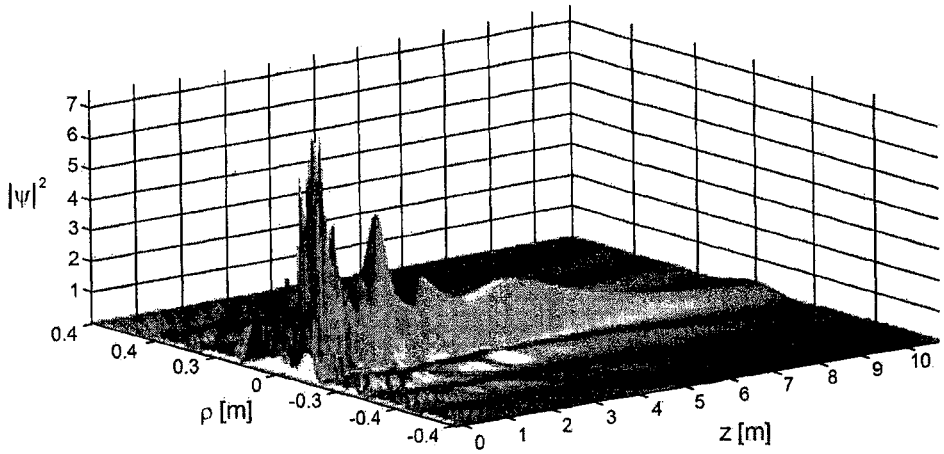
FIG. 12*a* shows, in three-dimensional view, a simulation of the field irradiated by the antenna of FIG. 10*a;*

FIG. 12*a* shows, in three-dimensional view, a simulation of the field irradiated by the antenna 1 of FIG. 10*a*.

Figure 12B:
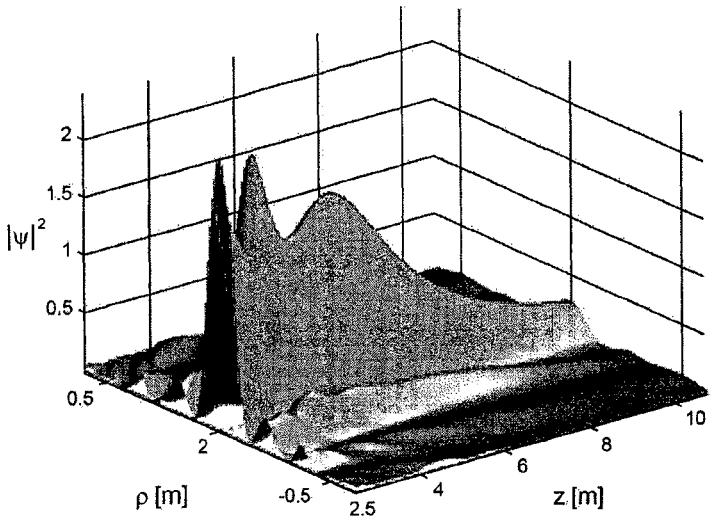
FIG. 12*b* shows, in three-dimensional view, the field of FIG. 12*a* excluding impulsive components generated at a short distance from the upper plate of the antenna.

At first sight, the field of FIG. 12*a* may appear different from the truncated Bessel beam that it is desired to obtain. This effect is, however, due to the fact that in the proximity of the aperture of the antenna 1 the field has isolated intensity peaks (caused by the radiating elements 4 themselves), which have the effect of rendering the field at a long distance far from clear for the purposes of simulation. This effect, which is due to the intensity peaks in the proximity of the upper plate 5 of the antenna 1, vanishes as the distance from the antenna 1 increases. FIG. 12*b* shows the same field excluding the components generated at a distance from the upper plate 5 of the antenna 1 of less than 2.5 m. In this case, the undesirable components have no effect on the resulting simulated field, which appears to be much more similar to a Bessel beam.

Figure 12D:
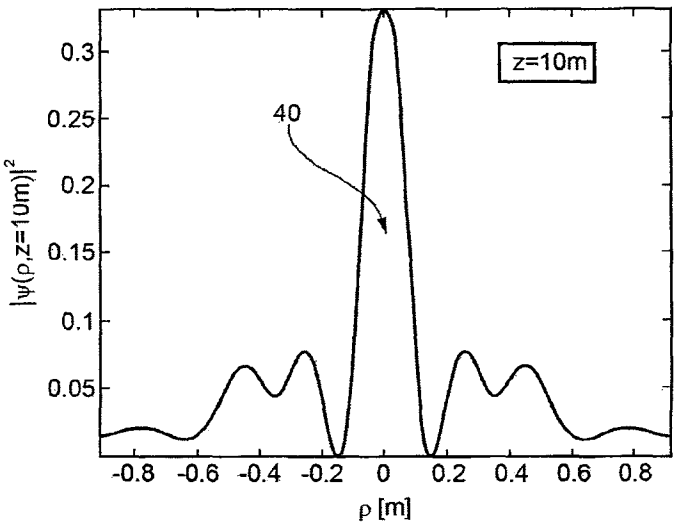
FIGS. 12*c* and 12*d* show, respectively, the stepwise field at the aperture of the antenna of FIG. 10*a* (superimposed on the Bessel function that is discretized), and the pattern of the transverse intensity of the beam generated by the antenna of FIG. 10*a* at a distance from the aperture.
Figure 12C:
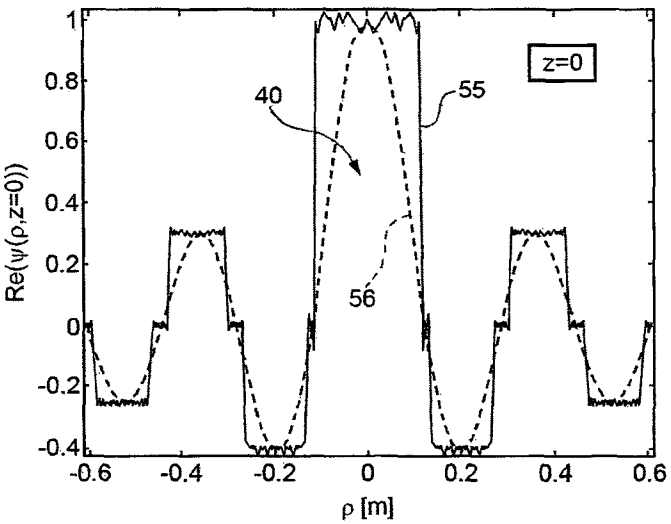

FIG. 12*c* shows, by means of the curve 55, the field at the aperture of the antenna 1, i.e., in z=0 (corresponding to the centre O of the antenna 1), whilst the curve 56 shows the Bessel function that is then "discretized" by the uniform fields in the annular apertures.

In turn, the function 55 represents the stepwise discretization adopted (where the oscillations are due to the approximations introduced in the series associated to said stepwise structure).

It may be noted that FIG. 12*c* shows the real part of the Bessel beam, with positive and negative values of amplitude. FIG. 12*d* shows the profile of the transverse intensity of the beam generated by the antenna 1 after 10 meters of propagation along the axis z, i.e., at z=10 m. From a comparison between FIG. 12*c* and FIG. 12*d*, it may be noted that, notwithstanding the reduction in intensity (which drops by approximately ⅓ with respect to the one that there is at the antenna, at z=0), the value of the radius of the central spot 40 varies minimally.

The applicant has moreover verified how the field generated by the antenna 1 varies as the values of the uniform fields $\Psi_0$-$\Psi_3$ supplied to each block 31*a*-31*d* vary with respect to what has been described previously.

The uniform field $\Psi_0$ supplied to the central circular aperture (block 31*a*) is kept at a constant value, equal to the one already indicated previously, whereas the uniform fields $\Psi_1$-$\Psi_3$ supplied, respectively, to the blocks 31*b*-31*d* are multiplied by the square root of (n+1), where n=1 for the block 31*b*, n=2 for the block 31*c*, and n=3 for the block 31*d*.

Figure 13A:
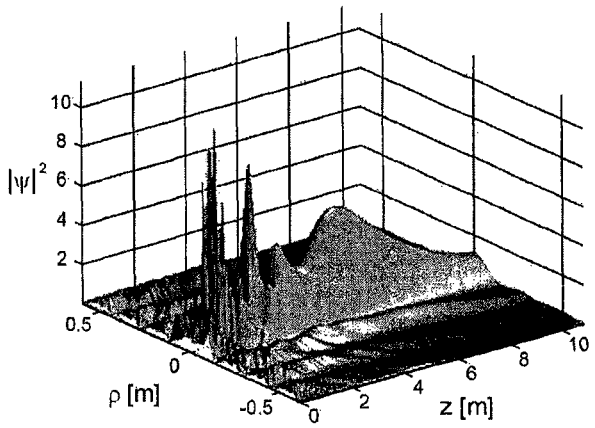
FIGS. 13*a*-13*c* show the field irradiated by the antenna of FIG. 10*a* when it is supplied by a rectangular field (superimposed, in FIG. 13*b*, on the irradiated field) with more intense side lobes than in the case of the normal Bessel beams, according to one embodiment of the present invention.
Figure 13B:
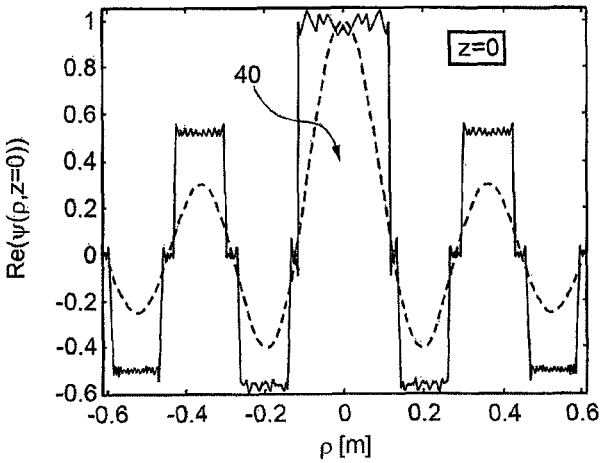
Figure 13C:
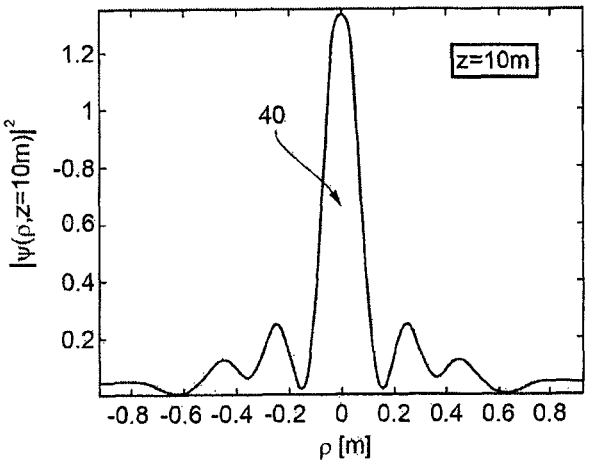

We hence have $\Psi_1=1$ a.u.; $\Psi_2=2^{1/2}\cdot J_0(k_\rho x_{r1})=-0.57$ a.u.; $\Psi_2=3^{1/2}\cdot J_0(k_\rho x_{r2})=0.52$ a.u.; $\Psi_3=4^{1/2}\cdot J_0(k_\rho x_{r3})=-0.5$ a.u. FIGS. 13*a*-13*c* show the field irradiated by an antenna 1 supplied using these values of field.

By increasing the intensity of field in the blocks 31*b*-31*d*, but not in the block 31*a*, the radius of the central spot 40 is kept unvaried, but the intensity distribution of the beam in $\rho=0$ (i.e., at the point of maximum of the central spot 40) assumes a more homogeneous pattern as the distance considered along the axis z varies. In practice, there is noted an improvement in the intensity of the central spot 40 in z=10 m as compared to the condition described with reference to FIG. 12*d*.

According to a further embodiment, all the values of $\Psi_0$-$\Psi_3$ (fields supplied to each block 31*a*-31*d*) are the same as one another (they have the same amplitude, which means the same field intensity). The phase, instead, varies by a value n from one block 31*a*-31*d* to another. In detail, we have $\Psi_0=1$ a.u.; $\Psi_1=1$ a.u. $\Psi_2=1$ a.u. $\Psi_3=1$ a.u.

Figure 14A:
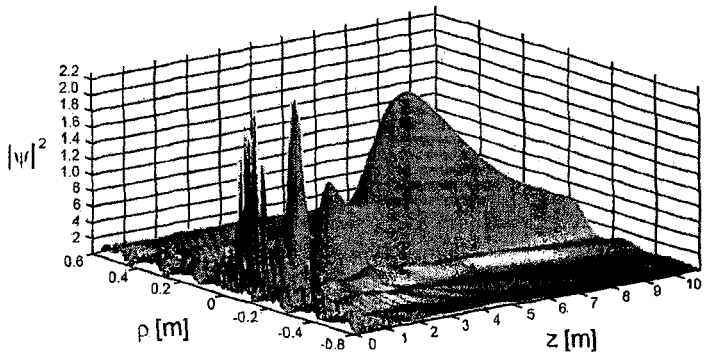
FIGS. 14*a*-14*c* show the field irradiated by the antenna of FIG. 10*a* when it is supplied by fields having in the side lobes an intensity higher than in the case of FIGS. 13*a*-13*c* and, in particular, equal to the central intensity.
Figure 14B:
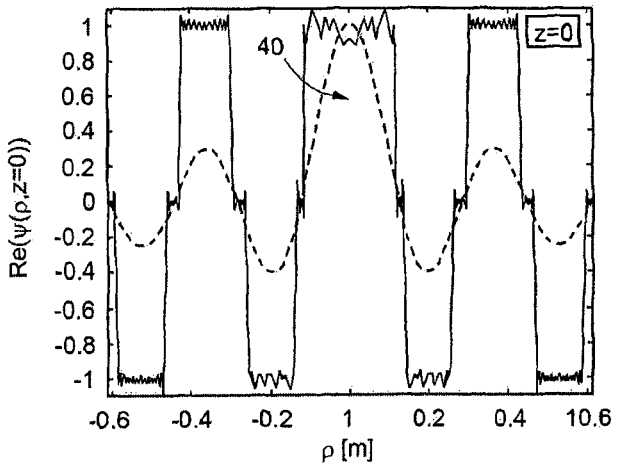
Figure 14C:
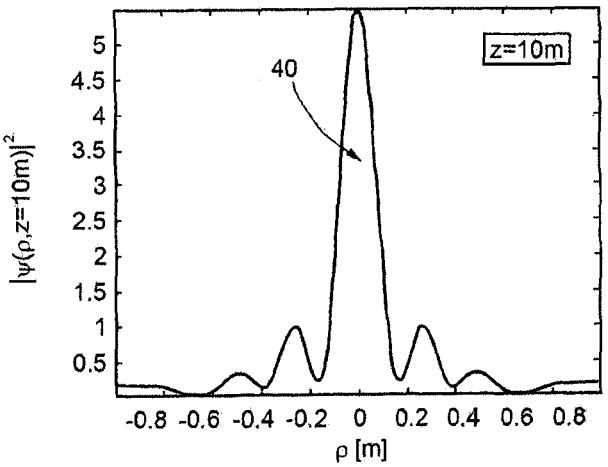

FIGS. 14*a*-14*c* show that, if the intensity of the field at the blocks 31*b*-31*d* is increased as compared to the cases previously described, the radius of the central spot 40 does not undergo apparent alterations, whereas there is an increase in the homogeneity and intensity on the axis Z, together with an increase in the intensity of the central spot 40 in z=10 m.

Figure 15:
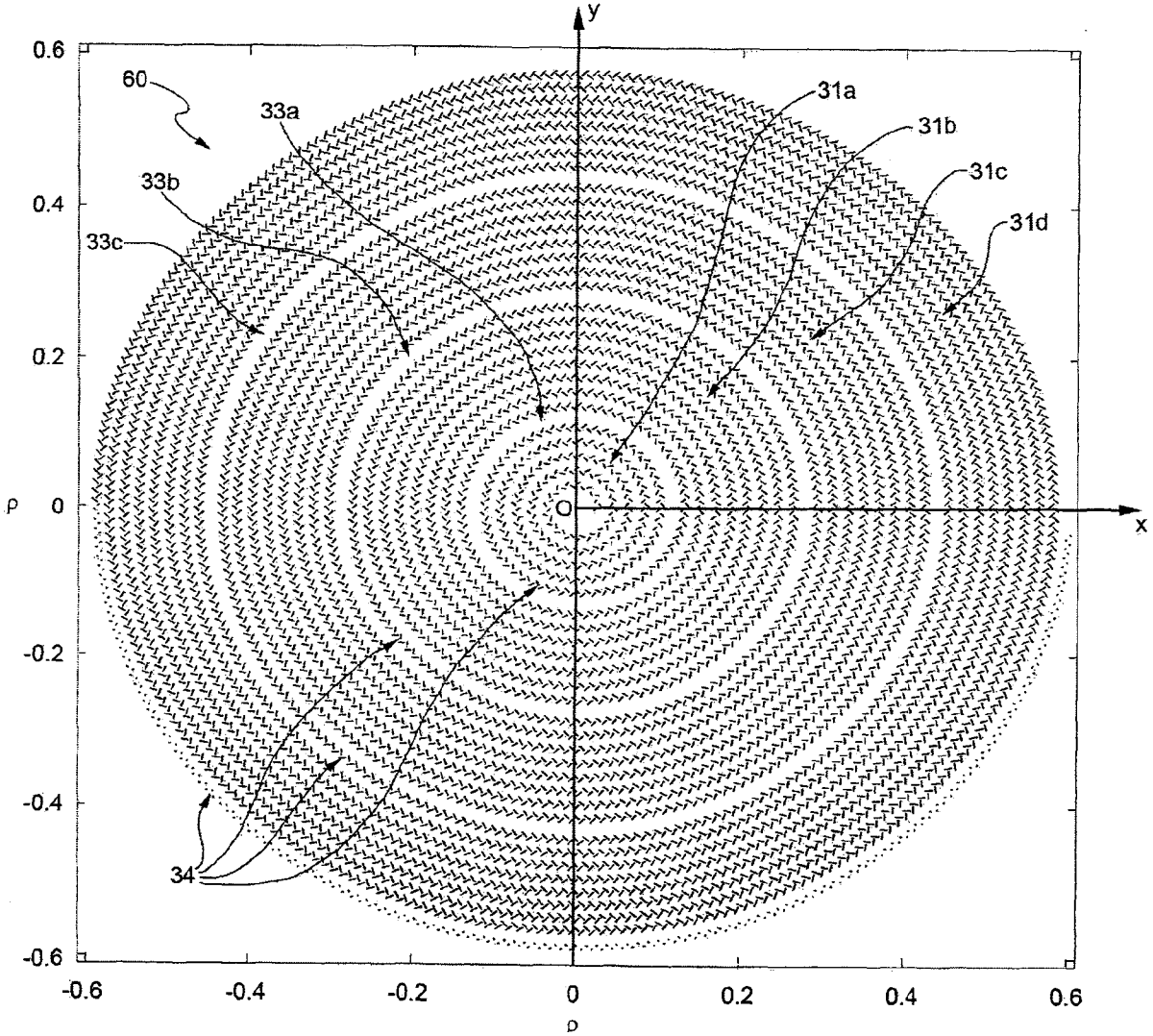
FIG. 15 shows, in top view, a slot antenna according to an embodiment alternative to that of FIG. 10*a*.

FIG. 15 shows an antenna 60 according to a further embodiment of the present invention. The antenna 60 is similar to the antenna 1 shown in FIG. 10*a*, but does not comprise transition grooves 34 of a size smaller than the grooves 4*a*, 4*b* that precede and follow the transition grooves 34 considered. According to the antenna 60 of FIG. 15, the transition from one block 31*a*-31*c* to the (radially) subsequent block 31*b*-31*d* is obtained by means of radiating elements 4, the dimensions of which (in particular, the length) increase, following the spiral, with the same law with which the dimensions (in particular, the length) of the radiating elements 4 belonging to the previous blocks 31*a*-31*c* and to the subsequent blocks 31*b*-31*d* increase.

The antenna 60 comprises: a number of radiating elements 4 equal to 9060; a minimum length of the radiating elements equal to 2 mm; a maximum length of the radiating elements equal to 9.5 mm; a constant width of the radiating elements equal to 0.9 mm; a maximum diameter of the antenna 60 equal to 1206 mm.

The value of return loss at 15 GHz, due to the radiating elements 4, has been evaluated as being −31 dB, and the radiation efficiency as being 93.4%.

The antenna 60 is, for example, supplied by means of uniform fields $\Psi_0$-$\Psi_3$ (fields supplied to each block 31*a*-31*d*) all having the same value, equal to 1 a.u.

Hence, for all the blocks 31*a*-31*d*, the value of the supply field $\Psi_0$-$\Psi_3$ is maintained at the same amplitude (i.e., the same intensity), but the phase varies by a value n from one block 31*a*-31*d* to another.

FIG. 16 shows the variation of the value of electrical field, normalized with respect to the maximum on the radiating aperture, according to this embodiment. FIG. 16 shows a target curve 65 and, superimposed thereon, a curve 66 that represents the pattern applied, as regards arrangement of the blocks 31*a*-31*d*, to the antenna of FIG. 15, in order to obtain it (in a way similar to what has already been described with reference to FIGS. 10*a*, 10*b*).

According to the spiral configuration of the antenna 60 (FIG. 15), which is continuous in the radial direction, the zero-amplitude guard areas at the transition between an area of positive current and an area of negative current have been ideally removed, thus obtaining the target curve 65. As has already been described with reference to FIG. 15, this corresponds to replacing the transition grooves 34 with portions of spiral similar to those that form the blocks 31*a*-31*d* (i.e., having the same progression of increase in dimensions of the grooves 4 already described with reference to blocks 31*a*-31*d*). In any case, at least in a radial direction of the antenna 60, a transition region is present between one block 31*a*-31*c* and the next block 31*b*-31*d*, where each pair 18 of grooves 4 is separated from the next pair 18 of grooves 4, in the chosen radial direction, by a distance greater than the distance that separates each pair 18 of grooves 4 forming part of one and the same block 31*a*-31*d*.

The target curve 65 is described by the formula according to Table 2 below (the radial distance is understood as being from the centre O of the antenna 60; the modulus and phase refer to the normalized electrical field).

TABLE 2

| Radial distance (ρ) | Modulus | Phase |
|---|---|---|
| 0 mm < ρ < 125 mm | 1 | 0° |
| 125 mm < ρ < 280 mm | 1 | 180° |
| 280 mm < ρ < 440 mm | 1 | 0° |
| 440 mm < ρ < 600 mm | 1 | 180° |

The curve 66 (field distribution used) is described by the formula according to Table 3 below.

TABLE 3

| Radial distance (ρ) | Modulus | Phase |
|---|---|---|
| ρ < 115 mm | 1 | 0° |
| 135 mm < ρ < 265 mm | 1 | 180° |
| 295 mm < ρ < 425 mm | 1 | 0° |
| 455 mm < ρ < 585 mm | 1 | 180° |
| Elsewhere | 0 | N.A. |

From an examination of the characteristics of the invention obtained according to the present disclosure the advantages that it affords are evident.

In particular, the antenna according to the present invention enables generation of localized waves in the field of electromagnetic waves, which have excellent properties in terms of low dispersion and low diffraction. The antenna according to the present invention preserves, for example, an energy spot of 10 cm in diameter at a distance of 10 meters measured from the antenna.

Finally, it is clear that modifications and variations may be made to what has been described and illustrated herein, without thereby departing from the sphere of protection of the present invention, as defined in the annexed claims.

For example, each radiating element 4 is selectively supplied, by means of a dedicated supply channel, with a signal having appropriate phase (and, according to one embodiment, the same amplitude). In particular, the phase is such as to respect the condition according to Table 1 described and illustrated previously. In this case, each radiating element 4 may be obtained in a way different from what has been described with reference to the antennas 1 and 60. For example, each radiating element 4 may be a slot or a printed element. The antenna thus formed behaves like a "phased array". This solution is very versatile, but also complex and difficult to manage on account of the complex supply network that it is necessary to provide.

According to further embodiments, the antenna 1 or 60 may comprise just the first grooves 4*a* and not also the second grooves 4*b*. The beam emitted by an antenna of this type still has the characteristics of a Bessel function, but more degraded.

According to yet a further embodiment, the radiating elements 4 may be set, instead of along the spiral 16, according to an ideal pattern formed by concentric circles, respecting in any case the dimensional constraints and the division into blocks 31*a*-31*d* set forth above.

Irrespective of whether the pattern is an ideal spiral or formed by concentric circles, the radiating elements 4 may comprise just the first grooves 4*a* or just the second grooves 4*b*.

In general, what has been described may be applied not only to a single Bessel beam, but to any beam of a frozen-wave type (i.e., superpositions of Bessel beams having the same frequency) with cylindrical symmetry.

Moreover, what has been described applies to structures with non-cylindrical symmetry (in this case, however, Bessel functions of order higher than zero should be considered).

The invention claimed is:

1. A radial slot antenna comprising:

a radial waveguide including an upper plate having a centroid and an edge region and provided with a plurality of radiating apertures formed as slots in the upper plate and positioned around the centroid, the plurality of radiating apertures comprising a plurality of first radiating apertures and a plurality of second radiating apertures;

wherein the plurality of first radiating apertures is arranged in such a way as to form at least one first radiating region, and the plurality of second radiating apertures is arranged in such a way as to form at least one second radiating region, the first and second radiating regions being distinct and radially separated by a dwell region without radiating apertures;

wherein the plurality of first radiating apertures of the first radiating region develops along a first spiral path forming a plurality of first turns, and the plurality of second radiating apertures of the second radiating region develops along a second spiral path forming a plurality of second turns;

wherein radially adjacent turns in the first spiral are separated from one another by a first mutual radial distance, and radially adjacent turns in the second spiral are separated from one another by a second mutual radial distance; and wherein the first radiating apertures and the second radiating apertures each comprise first grooves and second grooves, (a) the first grooves being arranged immediately one after another along the first spiral path or the second spiral path and being rotated with respect to one another in a counter clockwise direction by a first angular value that increases with a distance from the centroid, and (b) the second grooves being arranged immediately one after another along the first spiral path or the second spiral path and being rotated with respect to one another in a counter clockwise direction by a respective second angular value that increases with the distance from the centroid;

said slot antenna further comprising a signal feeder operable for supplying an electromagnetic field so as to assume, in the first and second radiating regions, opposite phases, in such a way that the electromagnetic field emitted by the slot antenna can be expressed via Bessel functions.

2. The antenna according to claim 1, further comprising a lower plate, made of electrically conductive material, set facing the upper plate, and a dielectric layer extending between the upper plate and the lower plate, wherein said signal feeder extends between the upper plate and the lower plate, which are substantially aligned, in a direction of alignment orthogonal to the radial direction, with the centroid so as to supply said electromagnetic field in the dielectric layer.

3. The antenna according to claim 2, wherein the upper plate and the lower plate form a flat-parallel-plate waveguide, said electromagnetic field being a circularly polarized wave.

4. The antenna according to claim 1, wherein the electromagnetic field is a uniform field.

5. The antenna according to claim 1, wherein said first and second spirals have the characteristics, in the first and second radiating regions, of an Archimedean spiral.

6. The antenna according to claim 1, wherein said waveguide has a circular shape with a diameter larger than approximately $40\lambda$ , where $\lambda$ , is the wavelength of the electromagnetic field supplied.

7. The antenna according to claim 1, wherein the radiating apertures are formed in pairs, each pair including a first slot and a second slot, which are formed in the upper plate, the first slot and the second slot having a substantially rectangular shape and extending at a distance from one another in respective main directions of extension substantially orthogonal to one another, each pair being set according to said ideal annular pattern.

8. The antenna according to claim 1, wherein the first and second radiating regions are located between consecutive zeros of the Bessel function that describes the electromagnetic field emitted by the slot antenna when considered at the upper plate.

* * * * *